US010263365B2

(12) United States Patent
Kato et al.

(10) Patent No.: US 10,263,365 B2
(45) Date of Patent: Apr. 16, 2019

(54) PLUG UNIT AND RECEPTACLE UNIT

(71) Applicant: ACES ELECTRONICS CO., LTD., Zhongli, Taoyuan County (TW)

(72) Inventors: Nobukazu Kato, Fussa (JP); Hiroaki Hashimoto, Sagamihara (JP)

(73) Assignee: ACES ELECTRONICS CO., LTD., Zhongli, Taoyuan (TW)

( * ) Notice: Subject to any disclaimer, the term of this patent is extended or adjusted under 35 U.S.C. 154(b) by 0 days.

(21) Appl. No.: 15/455,733

(22) Filed: Mar. 10, 2017

(65) Prior Publication Data

US 2017/0271806 A1 Sep. 21, 2017

(30) Foreign Application Priority Data

Mar. 15, 2016 (JP) ..... 2016-050451
Oct. 7, 2016 (JP) ..... 2016-198738

(51) Int. Cl.

*H01R 13/64* (2006.01)
*H01R 13/629* (2006.01)
*H01R 27/02* (2006.01)
*H01R 24/60* (2011.01)

(52) U.S. Cl.

CPC ..... *H01R 13/629* (2013.01); *H01R 27/02* (2013.01); *H01R 24/60* (2013.01)

(58) Field of Classification Search

CPC ..... H01R 13/629; H01R 27/02; H01R 24/60
USPC ..... 439/374, 701
See application file for complete search history.

(56) References Cited

U.S. PATENT DOCUMENTS

| | | | |
|---|---|---|---|
| 5,356,300 | A | 10/1994 | Costello et al. |
| 8,968,031 | B2 | 3/2015 | Simmel et al. |
| 9,472,911 | B2 | 10/2016 | Little et al. |
| 9,543,706 | B2 | 1/2017 | Zhang |
| 2010/0311268 | A1 | 12/2010 | Nguyen et al. |
| 2012/0009824 | A1 | 1/2012 | Sasaki et al. |
| 2013/0295796 | A1 | 11/2013 | Kato et al. |
| 2013/0330976 | A1 | 12/2013 | Simmel et al. |
| 2015/0056839 | A1 | 2/2015 | Zhang |
| 2015/0207279 | A1 | 7/2015 | Little et al. |

FOREIGN PATENT DOCUMENTS

| | | | |
|---|---|---|---|
| JP | H04-072575 | U1 | 6/1992 |
| JP | H07-94241 | A | 7/1995 |
| JP | 11-288760 | A | 10/1999 |

(Continued)

OTHER PUBLICATIONS

Japanese Decision of Rejection from Japanese Patent Application No. 2016-198738; dated Sep. 13, 2017; 7 pgs.

(Continued)

*Primary Examiner* — Khiem Nguyen
(74) *Attorney, Agent, or Firm* — Chiesa Shahinian & Giantomasi PC

(57) ABSTRACT

There is provided a plug unit including a plurality of predetermined standard plug connectors, the predetermined standard plug connectors each including a contact that connects with a connection terminal of a predetermined standard receptacle connector, and the plug unit includes one insulator which holds the contact that each of the plurality of predetermined standard plug connectors has and which defines an interval between the plurality of predetermined standard plug connectors and a posture of the predetermined standard plug connectors.

15 Claims, 30 Drawing Sheets

(56) References Cited

FOREIGN PATENT DOCUMENTS

| | | | |
|---|---|---|---|
| JP | 2005-268806 | A | 9/2005 |
| JP | 2007-174585 | A | 5/2007 |
| JP | 2010-225488 | A | 10/2010 |
| JP | 2012-018768 | A | 1/2012 |
| JP | 2013-48073 | A | 7/2013 |

OTHER PUBLICATIONS

Notification of Reasons for Refusal dated Jul. 25, 2017 from Japanese Application No. 2016-198738; 10 pages.
Notifications of Reasons for Refusal dated Sep. 25, 2018, in connection with Japanese Patent Application No. 2016-198738, 18 pgs.

PLUG UNIT AND RECEPTACLE UNIT

CROSS-REFERENCE TO RELATED APPLICATIONS

The present application claims priority to Japanese Patent Application No. 2016-050451, filed on Mar. 15, 2016, and Japanese Patent Application No. 2016-198738, filed on Oct. 7, 2016, the disclosures of which are herein incorporated by reference in their entirety.

TECHNICAL FIELD

The present invention relates to a plug unit including a plurality of predetermined standard plug connectors, and a receptacle unit including a plurality of predetermined standard receptacle connectors.

BACKGROUND ART

Portable terminal devices such as a tablet type PC and the like are used while being docked with peripheral equipment such as a keyboard, a mouse or the like in more and more cases. In such a case, in order to realize high-speed transmission, it is demanded to mount a docking connector including more contacts on a portable terminal device and peripheral equipment. For example, Patent Literature 1 recites a docking connector including a pair of connectors each having numerous contacts aligned, in which one connector is docked with the other connector.

CITATION LIST

Patent Literature

Patent Literature 1: JP H11-288760 A

SUMMARY OF INVENTION

Technical Problem

In the docking connector recited in JP H11-288760 A, one connector can be docked only with the other connector. Specifically, peripheral equipment with one connector mounted thereon can be docked with a portable terminal device with the other connector mounted thereon, but not with peripheral equipment mounted with other connector than the other connector.

Thus, use of a docking connector has been studied which includes two or more connectors conforming to the standard specification (hereinafter, referred to as a predetermined standard connector) such as the USB Type-C or the like. For example, a portable terminal device mounted with a receptacle side docking connector as a receptacle unit including two predetermined standard receptacle connectors can be docked not only with peripheral equipment mounted with a plug side docking connector as a plug unit including two predetermined standard plug connectors but also with peripheral equipment mounted with one predetermined standard plug connector. In other words, one of the two predetermined standard receptacle connectors provided in the receptacle side docking connector on the side of the portable terminal device can be docked with the peripheral equipment mounted with one predetermined standard plug connector. Further, the other of the two predetermined standard receptacle connectors provided in the above receptacle side docking connector can be connected with other peripheral equipment mounted with one predetermined standard plug connector as well.

However, in a step of assembling such a docking connector as described above, it is difficult to mount two predetermined standard connectors at an accurate position and in an accurate posture. When positions and postures of the two predetermined standard connectors deviate from each other during mounting, connection of the predetermined standard connector with a partner connector might develop a failure, or engagement of a predetermined standard connector with a partner connector might cause breakage.

Additionally, in order to realize higher speed transmission by increasing the number of contacts, it is demanded to mount an additional connector on a docking connector including two or more of such predetermined standard connectors as described above. However, mounting an additional connector increases a docking connector in size.

An object of the present invention is to provide a plug unit and a receptacle unit which enable a tolerance to be minimized and enable size reduction.

Solution to Problem

A plug unit of the present invention includes a plurality of predetermined standard plug connectors, the predetermined standard plug connectors each including a contact that connects with a connection terminal of a predetermined standard receptacle connector, and the plug unit includes one insulator which holds the contact that each of the plurality of predetermined standard plug connectors has and which defines an interval between the plurality of predetermined standard plug connectors and a posture of the predetermined standard plug connectors.

Additionally, the plug unit of the present invention includes a guide portion to be inserted, when docking with a receptacle unit including the plurality of predetermined standard receptacle connectors, before the predetermined standard plug connectors engage with the predetermined standard receptacle connectors, into a guide insertion portion of the receptacle unit.

Additionally, in the plug unit of the present invention, the guide portion includes a first additional connector.

Additionally, the plug unit of the present invention includes a plurality of predetermined standard plug connectors, and a cover which covers the plurality of predetermined standard plug connectors, and the plug unit includes a guide portion to be inserted, when docking with a receptacle unit including a plurality of predetermined standard receptacle connectors, before the predetermined standard plug connectors engage with the plug unit, into a guide insertion portion of the receptacle unit, wherein the guide portion is formed integrally with the cover.

Additionally, in the plug unit of the present invention, the cover has an opening portion for exposing an engagement portion in which the predetermined standard plug connector engages with the predetermined standard receptacle connector, and between an outer wall portion of the predetermined standard plug connector and a wall portion forming the opening portion, a predetermined space is formed such that the predetermined standard plug connectors can move on a cross plane crossing an engagement direction of engagement with the predetermined standard receptacle connectors, and the plug unit includes a control portion which controls, relative to the opening portion, at least either one of a position and a posture of at least one of the predetermined standard plug connectors.

Additionally, in the plug unit of the present invention, the guide portion and the cover are formed of resin, and the guide portion has metal incorporated therein.

Additionally, the plug unit of the present invention includes a first additional connector arranged in the guide portion.

Additionally, a plug unit of the present invention, which is a plug unit including a plurality of predetermined standard plug connectors, includes a guide portion which is inserted into a guide insertion portion of a receptacle unit having a plurality of predetermined standard receptacle connectors when docking with the receptacle unit, before the predetermined standard plug connector engages with the predetermined standard receptacle connector, and includes a first additional connector arranged in the guide portion.

Additionally, in the plug unit of the present invention, the predetermined standard plug connectors include contacts to be connected with connection terminals of the predetermined standard receptacle connectors, and one insulator is provided which holds the contacts that the plurality of predetermined standard plug connectors respectively have and which defines respective intervals between the plurality of predetermined standard plug connectors and postures of the predetermined standard plug connectors.

Additionally, in the plug unit of the present invention, the guide portion is formed in the periphery of the predetermined standard plug connector.

Additionally, in the plug unit of the present invention, the guide portion is formed between the plurality of predetermined standard plug connectors.

Additionally, in the plug unit of the present invention, the guide portion is formed of metal.

Additionally, in the plug unit of the present invention, a width of the guide portion in a direction orthogonal to an alignment direction in which the plurality of predetermined standard plug connectors is aligned is not less than an internal diameter width of an internal diameter of the predetermined standard receptacle connector in the direction orthogonal to the alignment direction.

Additionally, in the plug unit of the present invention, the guide portion has an arrangement portion in which the first additional connector is arranged.

Additionally, in the plug unit of the present invention, the first additional connector includes a first contact having a connection surface which connects with a connection terminal of a second additional connector, and the connection surface of the first contact is arranged on a top surface of the guide portion.

Additionally, in the plug unit of the present invention, the plurality of predetermined standard plug connectors is a reversible connector.

Additionally, the plug unit of the present invention includes at least two first additional connectors, and the receptacle unit includes at least one second additional connector connectable with the one first additional connector and the other first additional connector.

Additionally, in the plug unit of the present invention, the predetermined standard plug connector is of USB Type-C.

A receptacle unit of the present invention includes a plurality of predetermined standard receptacle connectors and is mounted on an electronic apparatus, and includes at least one guide reception portion which, when docking with a plug unit including a plurality of predetermined standard plug connectors, before the predetermined standard receptacle connectors engage with the predetermined standard plug connectors, receives a guide portion of the plug unit, wherein at least one predetermined standard receptacle connector of the plurality of predetermined standard receptacle connectors is mounted on a board independently of at least one other of the predetermined standard receptacle connectors, when at least two of the guide reception portions are provided, the at least two guide reception portions are integrally formed, and the guide reception portion is fixed to the board after the predetermined standard receptacle connectors are mounted on the board.

Additionally, in the receptacle unit of the present invention, the guide reception portion includes a second additional connector.

Additionally, in the receptacle unit of the present invention, the second additional connector includes a second contact, one end portion of which second contact is electrically connected with a first contact of the first additional connector and the other end portion of which second contact is electrically connected with a wire.

Additionally, in the receptacle unit of the present invention, the second additional connector includes a first engagement portion which engages with the first additional connector, and a second engagement portion which engages with a connector mounted on the board.

Additionally, in the receptacle unit of the present invention, the guide reception portion covers the predetermined standard receptacle connectors, and the guide reception portion and a shell of the predetermined standard receptacle connectors electrically conduct with each other.

Additionally, in the receptacle unit of the present invention, the guide reception portion includes a fixing portion to be fixed to the board, the fixing portion being arranged in the vicinity of the second additional connector and between the plurality of predetermined standard receptacle connectors.

Additionally, in the receptacle unit of the present invention, the guide reception portion is fixed to a casing of the electronic apparatus together with the board.

Additionally, in the receptacle unit of the present invention, the predetermined standard receptacle connectors are mounted on a mounting surface of the board such that an engagement direction of engagement with the predetermined standard plug connectors is parallel to the mounting surface, and the guide reception portion is fixed to the board from a position opposed to the mounting surface.

Additionally, in the receptacle unit of the present invention, the guide reception portion supports the predetermined standard receptacle connector in an insertion direction in which the guide portion of the plug unit is inserted into the guide reception portion.

Additionally, in the receptacle unit of the present invention, the electronic apparatus is a portable terminal device.

Additionally, in the receptacle unit of the present invention, the predetermined standard receptacle connector is of USB Type-C.

Advantageous Effects of Invention

According to the present invention, a plug unit and a receptacle unit can be provided which enable a tolerance to be minimized and realize size reduction.

DESCRIPTION OF EMBODIMENTS

Figure 1:
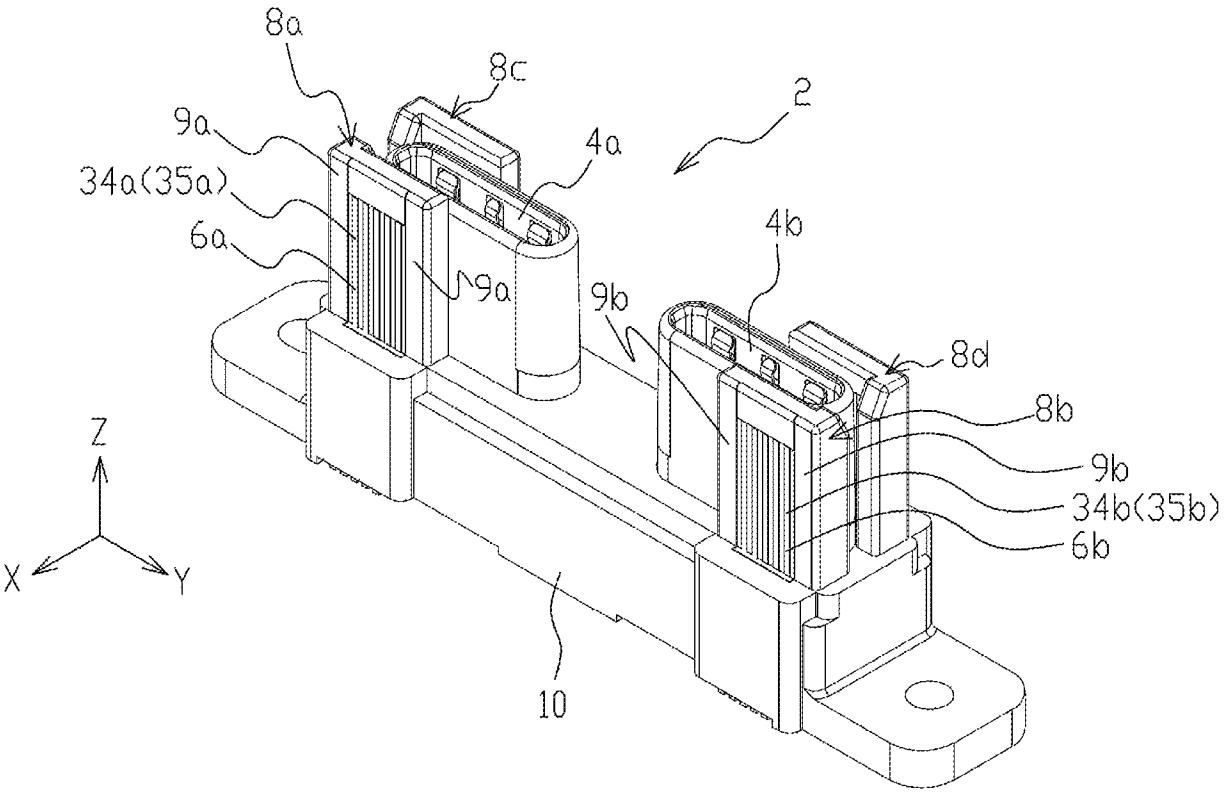
FIG. 1 is a perspective view showing an appearance of a plug docking connector according to a first embodiment.

In the following, with reference to the drawings, a docking connector according to a first embodiment of the present invention will be described. FIG. 1 is a perspective view showing an appearance of a docking connector on a plug side (hereinafter, referred to as a plug docking connector) as a plug unit according to the first embodiment. As shown in FIG. 1, a plug docking connector 2 includes a guide housing 10 having two USB Type-C plug connectors (hereinafter, referred to simply as a plug connector) 4*a* and 4*b*, four additional plug connectors 6*a* to 6*d* (for 6*c* and 6*d*, see FIG. 3), and four guides 8*a* to 8*d*. The docking connector is a connector for connecting a portable terminal device with an external apparatus, which represents, in a broad sense, such a docking connector as incorporated into an apparatus main body, as housed in a housing or the like and as connected with an apparatus via a cable or the like, or other.

Additionally, in the following, with an XYZ orthogonal coordinate system set as shown in FIG. 1, description will be made of a positional relationship and the like of each member with reference to the orthogonal coordinate system. A Y axis is set to be parallel to a direction in which the two plug connectors 4*a* and 4*b* are arranged. A Z axis is set to be parallel to a direction in which the plug docking connector 2 is docked with a receptacle docking connector 42 (see FIG. 4). An X axis is set to be in a direction orthogonal to a YZ plane. Additionally, a side of the guides 8*a* and 8*b* is set to be a +X direction and a side of the guides 8*c* and 8*d* is set to be a −X direction, a side of the plug connector 4*b* is set to be a +Y direction and a side of the plug connector 4*a* is set to be a −Y direction, and a direction in which the plug docking connector 2 is docked with the receptacle docking connector 42 is set to be a +Z direction and a direction in which the plug docking connector 2 is pulled out from the receptacle docking connector 42 is set to be a −Z direction.

Figure 2:
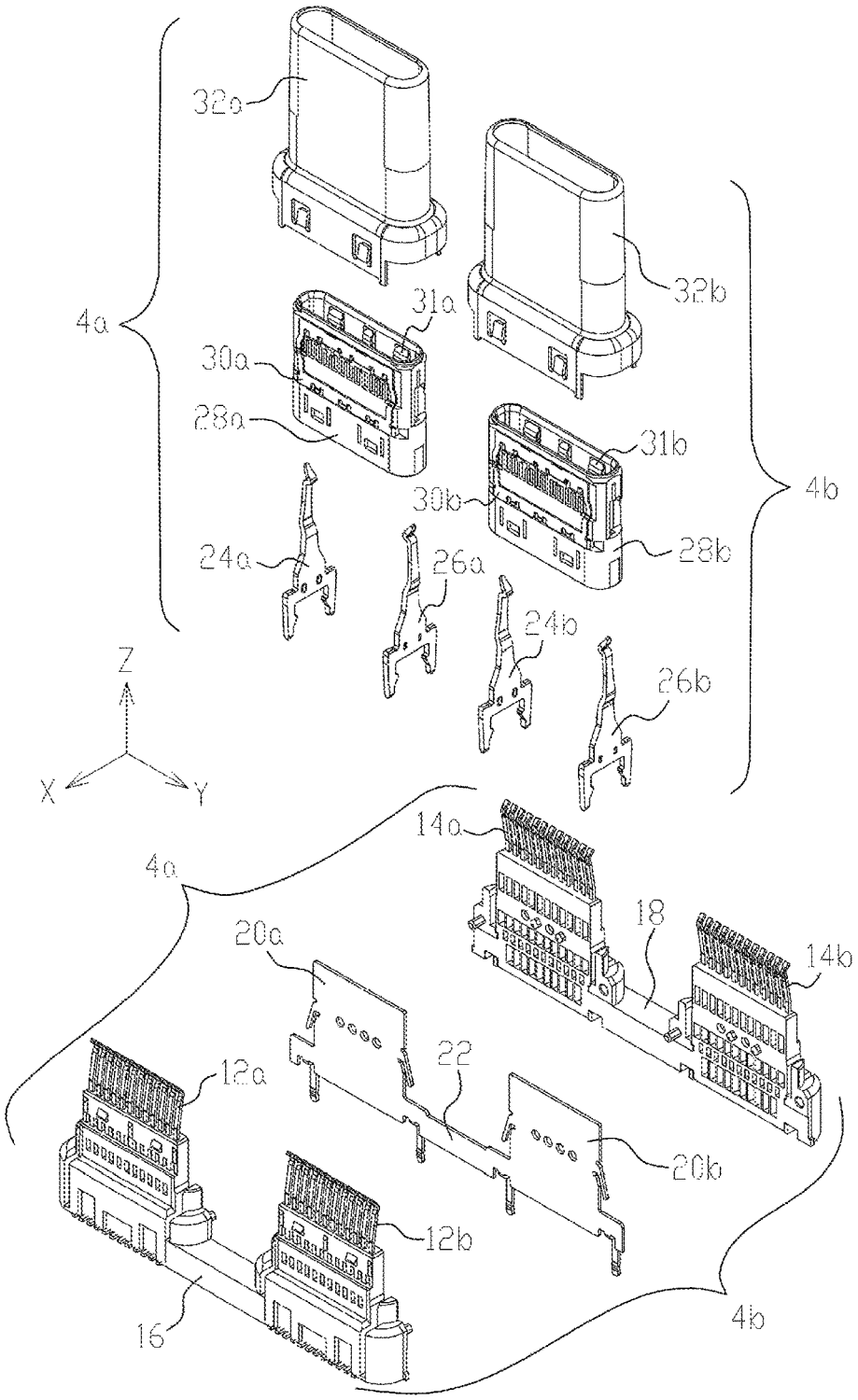
FIG. 2 is an exploded view showing a configuration of two plug connectors that the plug docking connector according to the first embodiment has.

FIG. 2 is an exploded view showing a configuration of the two plug connectors 4*a* and 4*b*. As shown in FIG. 2, the plug connector 4*a* includes a plurality of contacts 12*a* and 14*a* to be connected with a contact not shown and a contact 49*a* (see FIG. 5) of a USB Type-C receptacle connector (hereinafter, referred to simply as a receptacle connector) 44*a* which will be described later. The plurality of contacts 12*a* is arranged on the +X direction side of the plug connector 4*a*, the plurality of contacts 14*a* is arranged on the −X direction side of the plug connector 4*a*. Similarly, the plug connector 4*b* includes a plurality of contacts 12*b* and 14*b* to be connected with a contact not shown and a contact 49*b* (see FIG. 5) of a receptacle connector 44*b* which will be described later. The plurality of contacts 12*b* is arranged on the +X direction side of the plug connector 4*b* and the plurality of contacts 14*b* is arranged on the −X direction side of the plug connector 4*b*.

The plurality of contacts 12*a* and 12*b* are held by an insert housing 16 formed of one insulator. Similarly, the plurality of contacts 14*a* and 14*b* are held by an insert housing 18 formed of one insulator. The insert housings 16 and 18 define an interval between the plug connectors 4*a* and 4*b*, and postures of the plug connectors 4*a* and 4*b*. Defining the interval between the plug connectors 4*a* and 4*b*, and thus an interval between the contacts 12*a* and 12*b* and an interval between the contacts 14*a* and 14*b* enables the contacts 12*a* and 12*b* to be securely connected with the contacts not shown of the receptacle connectors 44*a* and 44*b*, and the contacts 14*a* and 14*b* to be securely connected with the contacts 49*a* and 49*b* (see FIG. 5). Additionally, defining the postures of the plug connectors 4*a* and 4*b*, i.e. defining an inclination on an XY plane, and a position and an inclination in the Z axis direction enables the plug connectors 4*a* and 4*b* to be securely engaged with the receptacle connectors 44*a* and 44*b* without damages.

Additionally, the plug connector 4*a* has a ground plate 20*a* between the contacts 12*a* and 14*a*, and the plug connector 4*b* includes a ground plate 20*b* between the contacts 12*b* and 14*b*, with the ground plates 20*a* and 20*b* being coupled by a coupling portion 22. Additionally, the plug connector 4*a* includes two ground contacts 24*a* and 26*a*, and the plug connector 4*b* includes two ground contacts 24*b* and 26*b*. The ground contact 24*a* is arranged on the −Y direction side of the plug connector 4*a*, and the ground contact 26*a* is arranged on the +Y direction side of the plug connector 4*a*, with the ground contacts 24*a* and 26*a* being connected with the ground plate 20*a*. The ground contact 24*b* is arranged on the −Y direction side of the plug connector 4*b*, and the ground contact 26*b* is arranged on the +Y direction side of the plug connector 4*b*, with the ground contacts 24*b* and 26*b* being connected with the ground plate 20*b*.

Additionally, the plug connector 4*a* has a housing 28*a* in which housing 28*a*, the plurality of contacts 12*a* held by the insert housing 16, the plurality of contacts 14*a* held by the insert housing 18, the ground plate 20*a*, and the two ground contacts 24*a* and 26*a* are arranged. Additionally, the housing 28*a* holds the ground plate contacts 30*a* and 31*a*.

The ground plate contact 30*a* is arranged on the +X direction side of the housing 28*a*. The ground plate contact 30*a* is connected with a receptacle ground shell not shown of the receptacle connector 44*a* when the plug connector 4*a* engages with the receptacle connector 44*a* (see FIG. 4). The ground plate contact 31*a* is arranged on the −X direction side of the housing 28*a*. The ground plate contact 31*a* is connected with a receptacle ground shell 52*a* (see FIG. 5) when the plug connector 4*a* engages with the receptacle connector 44*a*.

Similarly, the plug connector 4*b* has a housing 28*b*, in which housing 28*b*, the plurality of contacts 12*b* held by the insert housing 16, the plurality of contacts 14*b* held by the insert housing 18, the ground plate 20*b*, and the two ground contacts 24*b* and 26*b* are arranged. Additionally, the housing 28*b* holds ground plate contacts 30*b* and 31*b*.

The ground plate contact 30*b* is arranged on the +X direction side of the housing 28*b*. When the plug connector 4*b* engages with the receptacle connector 44*b* (see FIG. 4), the ground plate contact 30*b* is connected with the receptacle ground shell not shown of the receptacle connector 44*b*. The ground plate contact 31*b* is arranged on the −X direction side of the housing 28*b*. When the plug connector 4*b* engages with the receptacle connector 44*b*, the ground plate contact 31*b* is connected with a receptacle ground shell 52*b* (see FIG. 5).

Additionally, the plug connector 4*a* has a shell 32*a*, which shell 32*a* covers an outer circumference of the housing 28*a*, a side on which the plurality of contacts 12*a* of the insert housing 16 is held (the −Y direction side), and a side on which the plurality of contacts 14*a* of the insert housing 18 is held (the −Y direction side). Similarly, the plug connector 4*b* has a shell 32*b*, which shell 32*b* covers an outer circumference of the housing 28*b*, a side on which the plurality of contacts 12*b* of the insert housing 16 is held (the +Y direction side), and a side on which the plurality of contacts 14*b* of the insert housing 18 is held (the +Y direction side).

Figure 3:
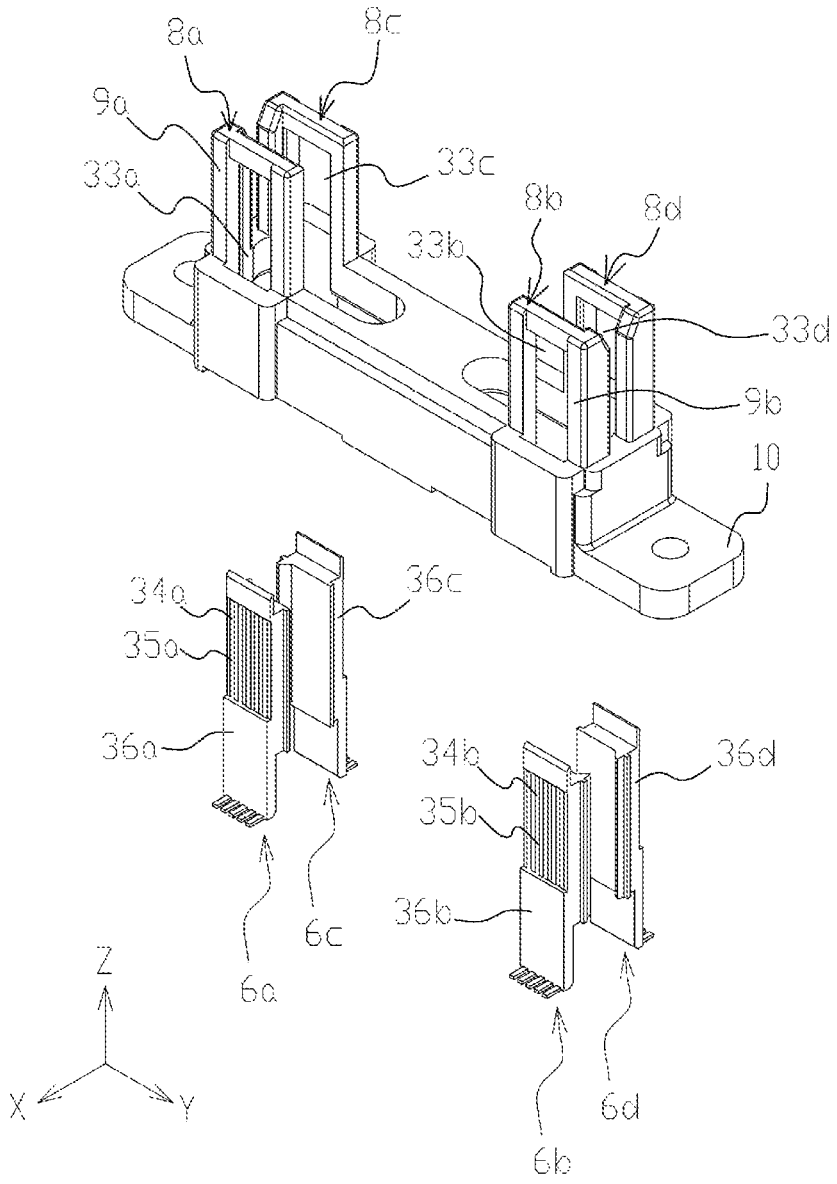
FIG. 3 is a view showing a configuration of a guide housing and an additional plug connector that the plug docking connector according to the first embodiment has.

FIG. 3 is a view showing configurations of the guide housing 10 and the additional plug connectors 6*a* to 6*d*. The guide housing 10, as shown in FIG. 3, includes the four guides 8*a* to 8*d* to hold the two plug connectors 4*a* and 4*b*. The four guides 8*a* to 8*d* are formed of a material having high strength, e.g. metal, and formed in the periphery of the two plug connectors 4*a* and 4*b*. Specifically, the guide 8*a* is formed on the +X direction side and the −Y direction side of the plug connector 4*a*, the guide 8*b* is formed on the +X direction side and the +Y direction side of the plug connector 4*b*, the guide 8*c* is formed on the −X direction side and the −Y direction side of the plug connector 4*a*, and the guide 8*d* is formed on the −X direction side and the +Y direction side of the plug connector 4*b*.

In the guide 8*a*, an opening 33*a* is formed in which the additional connector 6*a* fits, as an arrangement portion in which the additional connector 6*a* is arranged. Similarly, in the guides 8*b* to 8*d*, openings 33*b* to 33*d* are formed in which the additional connectors 6*b* to 6*d* fit, as arrangement portions in which the additional connectors 6*b* to 6*d* are arranged. The arrangement portions can be configured to be provided with, other than openings, concaves in which the additional connectors 6*a* to 6*d* fit.

Additionally, front end portions on the +Z direction side of the guides 8*a* to 8*d* protrude more in the +Z direction than front end portions on the +Z direction side of the plug connectors 4*a* and 4*b*. Specifically, the guides 8*a* to 8*d* protrude more than the plug connectors 4*a* and 4*b* to a side of an insertion direction (the +Z direction) in which the guides 8*a* to 8*d* are inserted into the guide insertion portions 48*a* to 48*d* (see FIG. 4). Accordingly, when the plug docking connector 2 docks with the receptacle docking connector 42, the guides 8*a* to 8*d* are inserted into the guide insertion portions 48*a* to 48*d* of the receptacle docking connector 42 before the plug connectors 4*a* and 4*b* start engaging with the receptacle connectors 44*a* and 44*b*.

As shown in FIG. 1, the additional plug connector 6*a* is arranged in the opening 33*a* of the guide 8*a*. As shown in FIG. 3, the additional plug connector 6*a* includes a plurality (five in the first embodiment) of contacts 34*a*, and a housing 36*a* which holds the plurality of contacts 34*a*. As shown in FIG. 3, the contacts 34*a* each have a connection surface 35*a* which connects with a connection terminal 58*a* (see FIG. 5) of a contact 56*a* of an additional receptacle connector 46*a* (see FIG. 4). As shown in FIG. 1, the connection surface 35*a* is arranged on a plane substantially flush with a guide surface 9*a* as a top surface of the guide 8*a*.

The additional plug connector 6*b* is arranged in the opening 33*b* of the guide 8*b*, and includes a plurality (five in the first embodiment) of contacts 34*b*, and a housing 36*b* which holds the plurality of contacts 34*b*. The contacts 34*b* each have a connection surface 35*b* which connects with a connection terminal 58*b* (see FIG. 5) of a contact 56*b* of an additional receptacle connector 46*b* (see FIG. 4). As shown in FIG. 1, the connection surface 35*b* is arranged on a plane substantially flush with a guide surface 9*b* as a top surface of the guide 8*b*.

The additional plug connector 6*c* is arranged in the opening 33*c* of the guide 8*c* and includes a plurality of contacts (not shown), and a housing 36*c* which holds the plurality of contacts. The additional plug connector 6*d* is arranged in an opening 33*d* of the guide 8*d* and includes a plurality of contacts (not shown), and a housing 36*d* which holds the plurality of contacts.

Figure 4:
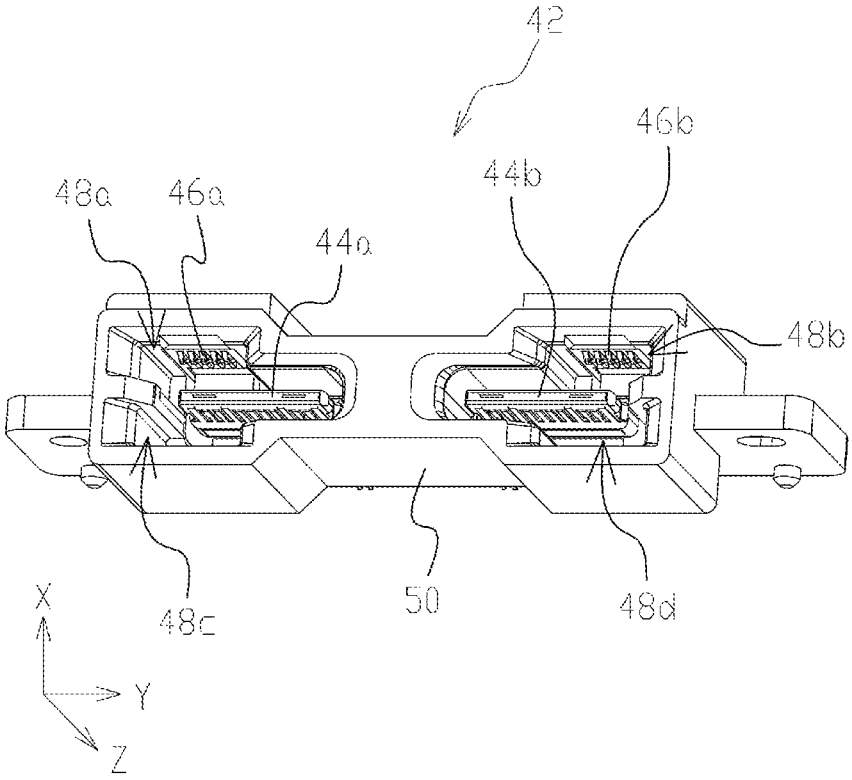
FIG. 4 is a perspective view showing an appearance of a receptacle docking connector according to the first embodiment.

Next, description will be made of a docking connector on a receptacle side (hereinafter, referred to as a receptacle docking connector) as a receptacle unit according to the first embodiment of the present invention with reference to the drawings. FIG. 4 is a perspective view showing an appearance of the receptacle docking connector according to the first embodiment. The receptacle docking connector 42 is mounted on a portable terminal device such as a tablet type PC or the like, and as shown in FIG. 4, includes a guide shell 50 having the two receptacle connectors 44*a* and 44*b*, the two additional receptacle connectors 46*a* and 46*b*, and the four guide insertion portions 48*a* to 48*d*.

Figure 5:
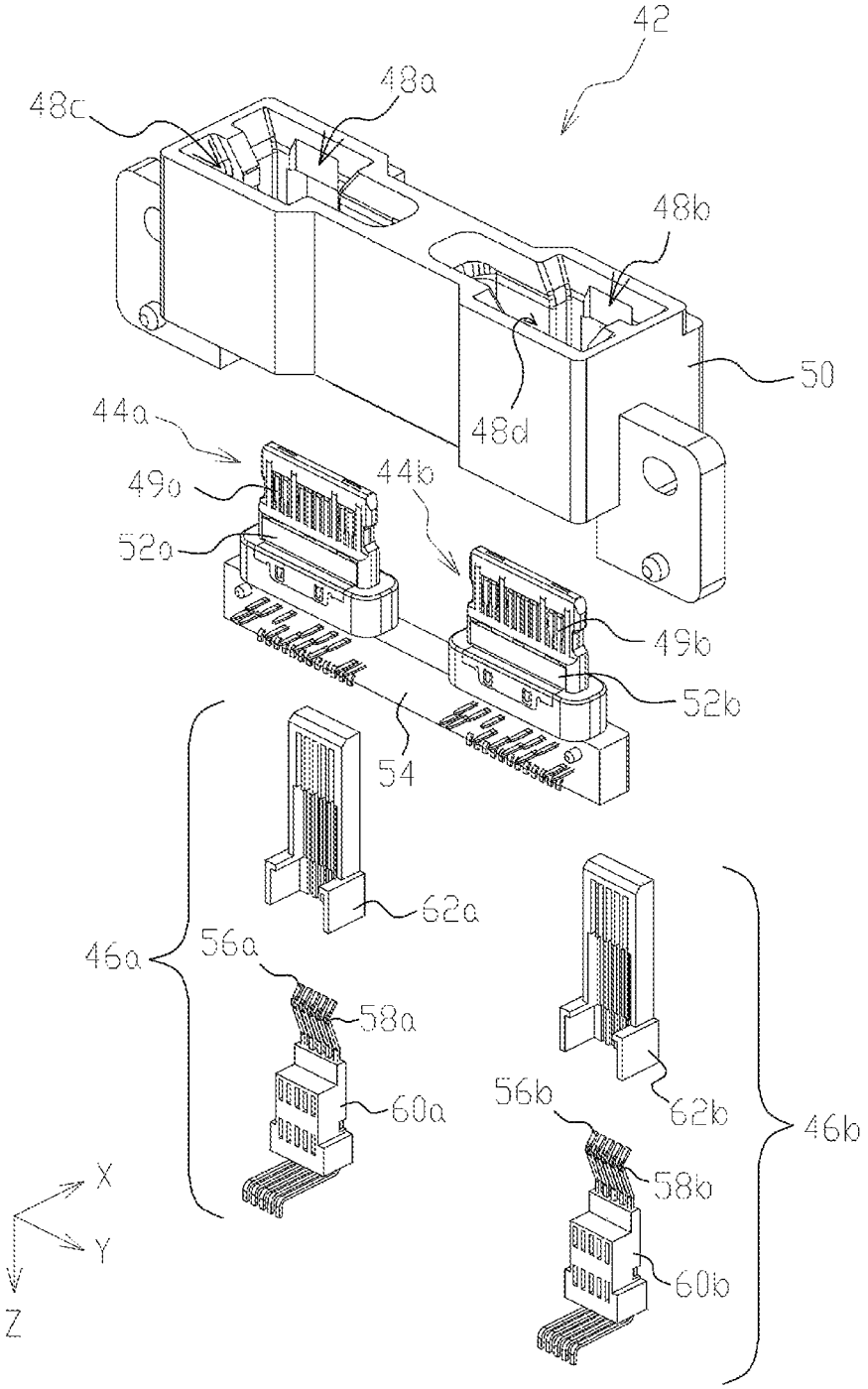
FIG. 5 is an exploded view showing a configuration of the receptacle docking connector according to the first embodiment.

FIG. 5 is an exploded view for explaining a configuration of the receptacle docking connector 42. As shown in FIG. 5, the receptacle connector 44*a* includes a plurality of contacts (not shown) which connects with the contacts 12*a* of the plug connector 4*a*, and the plurality of contacts 49*a* which connects with the contact 14*a*. The plurality of contacts not shown is arranged on the +X direction side of the receptacle connector 44*a*, and the plurality of the contact 49*a* is arranged on the −X direction side of the receptacle connector 44*a*. Similarly, the receptacle connector 44*b* includes a plurality of contacts (not shown) which connects with the contacts 12*b* of the plug connector 4*b*, and the plurality of the contacts 49*b* which connects with the contact 14*b*. The plurality of contacts not shown is arranged on the +X direction side of the receptacle connector 44*b*, and the plurality of contacts 49*b* is arranged on the −X direction side of the receptacle connector 44*b*.

Additionally, the receptacle connector 44*a* includes the receptacle ground shell 52*a*, and a receptacle ground shell not shown. The receptacle ground shell 52*a* is arranged on the −X direction side of the receptacle connector 44*a*, and the receptacle ground shell not shown is arranged on the +X direction side of the receptacle connector 44*a*. When the receptacle connector 44*a* engages with the plug connector 4*a*, the receptacle ground shell 52*a* connects with the ground plate contact 31*a*. When the receptacle connector 44*a* engages with the plug connector 4*a*, the receptacle ground shell not shown connects with the ground plate contact 30*a*.

The receptacle connector 44*b* includes the receptacle ground shell 52*b* and a receptacle ground shell not shown. The receptacle ground shell 52*b* is arranged on the −X direction side of the receptacle connector 44*b*, and the receptacle ground shell not shown is arranged on the +X direction side of the receptacle connector 44*a*. When the receptacle connector 44*b* engages with the plug connector 4*b*, the receptacle ground shell 52*b* connects with the ground plate contact 31*b*. When the receptacle connector 44*b* engages with the plug connector 4*b*, the receptacle ground shell not shown connects with the ground plate contact 30*b*.

The plurality of contacts 49*a* and 49*b*, a plurality of contacts not shown of the receptacle connectors 44*a* and 44*b*, the receptacle ground shells 52*a* and 52*b*, and receptacle ground shells not shown of the receptacle connectors 44*a* and 44*b* are held by a receptacle housing 54 formed of one insulator. The receptacle housing 54 defines an interval between the receptacle connectors 44*a* and 44*b*, and postures of the receptacle connectors 44*a* and 44*b*. Defining the interval between the receptacle connectors 44*a* and 44*b*, and thus an interval between the contacts 49*a* and 49*b* enables the contacts 49*a* and 49*b* to be securely connected with the contacts 14*a* and 14*b* of the plug connectors 4*a* and 4*b*. Similarly, defining an interval between contacts not shown of the receptacle connector 44*a* and contacts not shown of the receptacle connector 44*b* enables the contacts not shown of the receptacle connector 44*a* and the contacts not shown of the receptacle connector 44*b* to be securely connected with the contacts 12*a* and 12*b* of the plug connectors 4*a* and 4*b*. Additionally, defining the postures of the receptacle connectors 44*a* and 44*b*, i.e. defining an inclination on the XY plane, and a position and an inclination in the Z axis direction enables the receptacle connectors 44*a* and 44*b* to be securely engaged with the plug connectors 4*a* and 4*b* without damages.

The guide shell 50 covers an outer circumference of the receptacle housing 54 (the receptacle connectors 44*a* and 44*b*) and holds the two receptacle connectors 44*a* and 44*b* by holding the receptacle housing 54. The guide shell 50 includes the four guide insertion portions 48*a* to 48*d*, which are formed in the periphery of the receptacle connectors 44*a* and 44*b*. Specifically, the guide insertion portion 48*a* is formed on the +X direction side and on the −Y direction side of the receptacle connector 44*a*, the guide insertion portion 48*b* is formed on the +X direction side and on the +Y direction side of the receptacle connector 44*b*, the guide insertion portion 48*c* is formed on the −X direction side and the −Y direction side of the receptacle connector 44*a*, and the guide insertion portion 48*d* is formed on the −X direction side and on the +Y direction side of the receptacle connector 44*b*.

Additionally, insertion ports of the guide insertion portions 48*a* to 48*d* protrude more in the −Z direction side than front end portions of the receptacle connectors 44*a* and 44*b* on the −Z direction side. Accordingly, when the receptacle docking connector 42 docks with the plug docking connector 2, the guide insertion portions 48*a* to 48*d* receive the guides 8*a* to 8*d* of the plug docking connector 2 before the receptacle connectors 44*a* and 44*b* start engaging with the plug connectors 4*a* and 4*b*.

As shown in FIG. 4, the additional receptacle connector 46*a* is arranged on the +X direction side of the guide insertion portion 48*a*. As shown in FIG. 5, the additional receptacle connector 46*a* includes the plurality (five in the first embodiment) of contacts 56*a*. The contact 56*a* has the connection terminal 58*a* which connects with the contact 34*a* of the additional plug connector 6*a*, the connection terminal 58*a* being formed of an elastic body. Additionally, the additional receptacle connector 46*a* includes an additional receptacle housing 60*a* which holds the plurality of contacts 56*a*, and a receptacle guide housing 62*a* which holds the additional receptacle housing 60*a*.

As shown in FIG. 4, the additional receptacle connector 46*b* is arranged on the +X direction side of the guide insertion portion 48*b*. As shown in FIG. 5, the additional receptacle connector 46*b* includes the plurality (five in the first embodiment) of contacts 56*b*. The contact 56*b* has the connection terminal 58*b* which connects with the contact 34*b* of the additional plug connector 6*b*, the connection terminal 58*b* being formed of an elastic body. Additionally, the additional receptacle connector 46*b* includes an additional receptacle housing 60*b* which holds the plurality of contacts 56*b*, and a receptacle guide housing 62*b* which holds the additional receptacle housing 60*b*.

Figure 6:
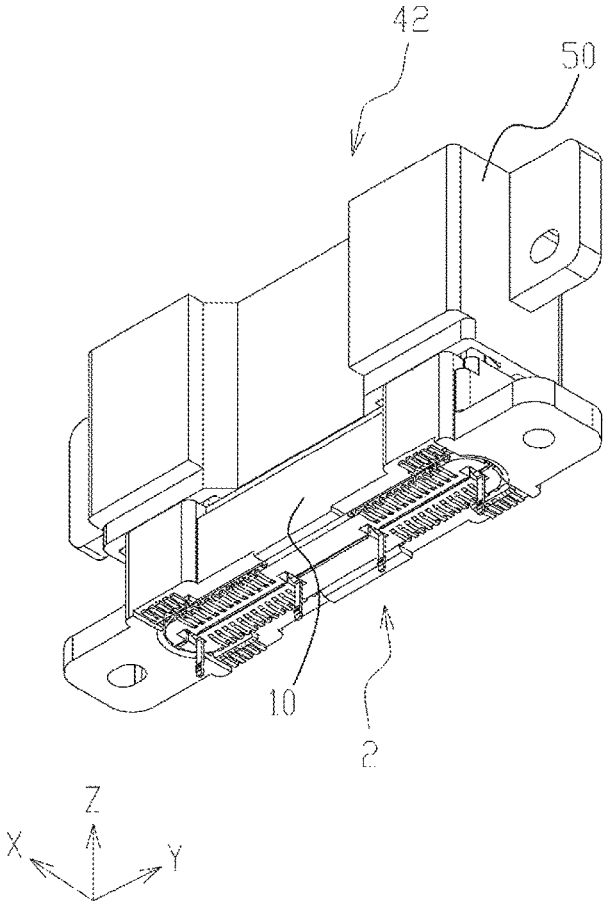
FIG. 6 is a view showing a state where the plug docking connector and the receptacle docking connector according to the first embodiment are engaged with each other.

In the above-described first embodiment, as shown in FIG. 6, the description has been made of a case where the receptacle connector 44*a* is engaged with the plug connector 4*a*, and the receptacle connector 44*b* is engaged with the plug connector 4*b*. In this case, the additional receptacle connector 46*a* is connected with the additional plug connector 6*a*, and the additional receptacle connector 46*b* is connected with the additional plug connector 6*b*. However, the plug docking connector 2 and the receptacle docking connector 42 according to the first embodiment are reversible connectors, and the receptacle connector 44*a* can be engaged with the plug connector 4*b*, and the receptacle connector 44*b* can be engaged with the plug connector 4*a* as well. In this case, the additional receptacle connector 46*a* is connected with the additional plug connector 6*d*, and the additional receptacle connector 46*b* is connected with the additional plug connector 6*c*.

A plurality of contacts not shown of the additional plug connector 6*c* each have a connection surface which connects with the connection terminal 58*b* of the contact 56*b* of the additional receptacle connector 46*b*. The connection surface is arranged on a plane substantially flush with a guide surface (not shown) as a top surface of the guide 8*c*. Similarly, a plurality of contacts not shown of the additional plug connector 6*d* each have a connection surface which connects with the connection terminal 58*a* of the contact 56*a* of the additional receptacle connector 46*a*. The connection surface is arranged on a plane substantially flush with a guide surface (not shown) as a top surface of the guide 8*d*.

With the plug docking connector 2 according to the first embodiment, since the plurality of contacts 12*a* and 12*b* is held by the insert housing 16 formed of one insulator, and the plurality of contacts 14*a* and 14*b* is held by the insert housing 18 formed of one insulator, an interval between the plug connectors 4*a* and 4*b* and postures of the plug connectors 4*a* and 4*b* are defined. Accordingly, a tolerance can be minimized to enable the contacts 12*a* and 12*b* to be securely connected with the contacts not shown of the receptacle connectors 44*a* and 44*b*, and the contacts 14*a* and 14*b* to be securely connected with the contacts 49*a* and 49*b*. Additionally, the plug connectors 4*a* and 4*b* can be securely engaged with the receptacle connectors 44*a* and 44*b* without damages.

Additionally, with the receptacle docking connector 42 according to the first embodiment, since the contacts 49*a* and 49*b* and the like are held by the receptacle housing 54 formed of one insulator, an interval between the receptacle connectors 44*a* and 44*b* and postures of the receptacle connectors 44*a* and 44*b* are defined. Accordingly, a tolerance can be minimized to enable the contacts not shown of the receptacle connectors 44*a* and 44*b* to be securely connected with the contacts 12*a* and 12*b*, and the contacts 49*a* and 49*b* to be securely connected with the contacts 14*a* and 14*b*. Additionally, the receptacle connectors 44*a* and 44*b* can be securely engaged with the plug connectors 4*a* and 4*b* without damages.

Additionally, although when a connector is further added to a docking connector having predetermined standard connectors such as a plurality of connectors conforming to the standard specification, there occurs a problem of an increase in the docking connector, with the plug docking connector 2 according to the first embodiment, since the additional plug connectors 6*a* to 6*d* are arranged in the guides 8*a* to 8*d*, the plug docking connector 2 can be reduced in size. Similarly, with the receptacle docking connector 42 according to the first embodiment, since the additional receptacle connectors 46*a* and 46*b* are arranged in the guide insertion portions 48*a* and 48*b*, the receptacle docking.

Although the above plug docking connector 2 according to the first embodiment has been described with respect to a case where the guide surfaces 9*a* and 9*b* of the guides 8*a* and 8*b* are plane surfaces, the present invention is applicable also to a case where the guide surfaces are curved surfaces. Even when the guide surfaces are curved surfaces, the connection surfaces 35*a* and 35*b* can be arranged on a plane substantially flush with the guide surfaces. Similarly, guide surfaces not shown of the guides 8*c* and 8*d* are also plane surfaces or curved surfaces, and connection surfaces not shown of the additional connectors 6*c* and 6*d* are arranged on a plane substantially flush with the guide surfaces not shown of the guides 8*c* and 8*d*.

Additionally, although the above plug docking connector 2 according to the first embodiment is provided with the four additional plug connectors 6*a* to 6*d*, only at least two additional plug connectors need to be provided. Additionally, although the above receptacle docking connector 42 according to the embodiment is provided with the two additional receptacle connectors 46*a* and 46*b*, only at least one additional receptacle connector need to be provided.

Additionally, in the above plug docking connector 2 according to the first embodiment, the front end portions of the guides 8*a* to 8*d* in the +Z direction protrude more than the front end portions of the plug connectors 4*a* and 4*b*, and the insertion ports of the guide insertion portions 48*a* to 48*d* of the receptacle docking connector 42 protrude more than the front end portions of the receptacle connectors 44*a* and 44*b*. However, only at least either one of the front end portions of the guides 8*a* to 8*d* and the insertion ports of the guide insertion portions 48*a* to 48*d* need to protrude. Specifically, the configuration need only allow the guides 8*a* to 8*d* to be inserted into the guide insertion portions 48*a* to 48*d* before the plug connectors 4*a* and 4*b* start engaging with the receptacle connectors 44*a* and 44*b*.

Figure 7:
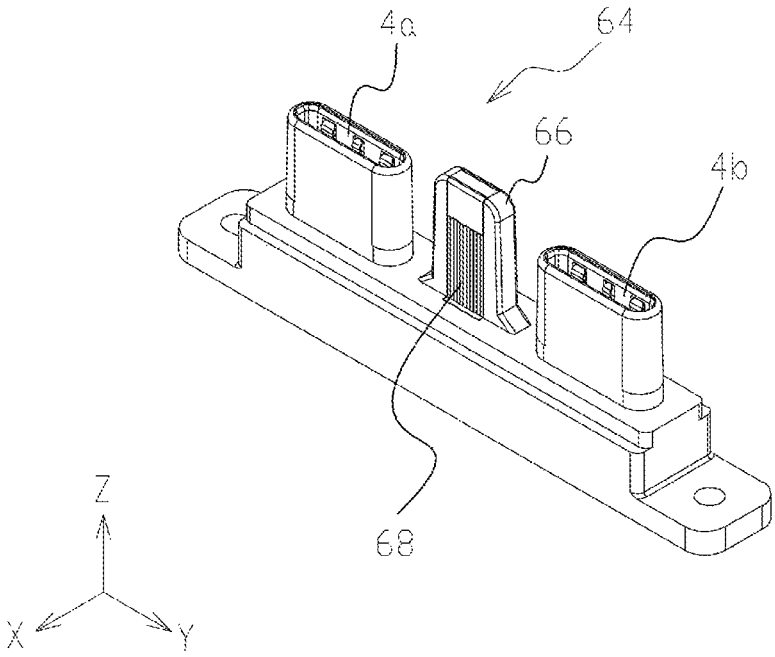
FIG. 7 is a view showing a configuration of other plug docking connector.
Figure 8:
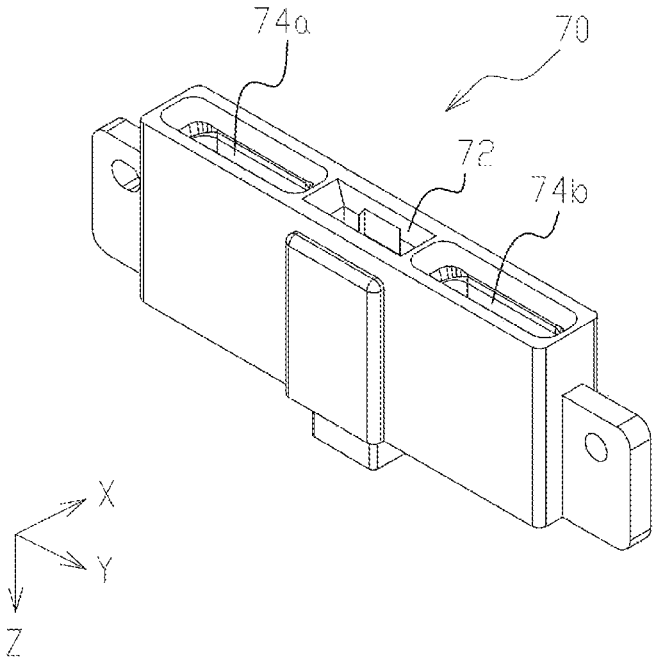
FIG. 8 is a view showing a configuration of other receptacle docking connector.

Additionally, although in the above plug docking connector 2 according to the first embodiment, the guides 8*a* to 8*d* are formed around the plug connectors 4*a* and 4*b*, a guide 66 can be formed between the plug connectors 4*a* and 4*b*, for example, such a plug docking connector 64 as shown in FIG. 7. In this case, as shown in FIG. 7, at least one additional plug connector 68 is arranged in the guide 66. FIG. 8 is a view showing an appearance of a receptacle docking connector 70 which docks with the plug docking connector 64 shown in FIG. 7. While in the above receptacle docking connector 42 according to the embodiment, the guide insertion portions 48*a* to 48*d* are formed around the receptacle connectors 44*a* and 44*b*, in the receptacle docking connector 70, as shown in FIG. 8, a guide insertion portion 72 is formed between housing portions 74*a* and 74*b* which house the receptacle connectors 44*a* and 44*b* (see FIG. 4). In this case, at least one additional receptacle connector (not shown) which connects with the plug connector 68 is arranged in the guide insertion portion 72.

The guide 66 shown in FIG. 7 is formed of a material having high strength, e.g. metal, and a front end portion of the guide 66 protrudes in the +Z direction more than the front end portions of the plug connectors 4*a* and 4*b*. Accordingly, when the plug docking connector 64 docks with the receptacle docking connector 70, the guide 66 is inserted into the guide insertion portion 72 of the receptacle docking connector 70 before the plug connectors 4*a* and 4*b* start engaging with the receptacle connectors 44*a* and 44*b*. Since in the plug docking connector 64 and the receptacle docking connector 70, one guide 66 and guide insertion portion 72 are provided, respectively, and the additional plug connector 68 is arranged in the guide 66 and the additional receptacle connector is arranged in the guide insertion portion 72, the plug docking connector 64 and the receptacle docking connector 70 can be reduced in size.

Figure 9:
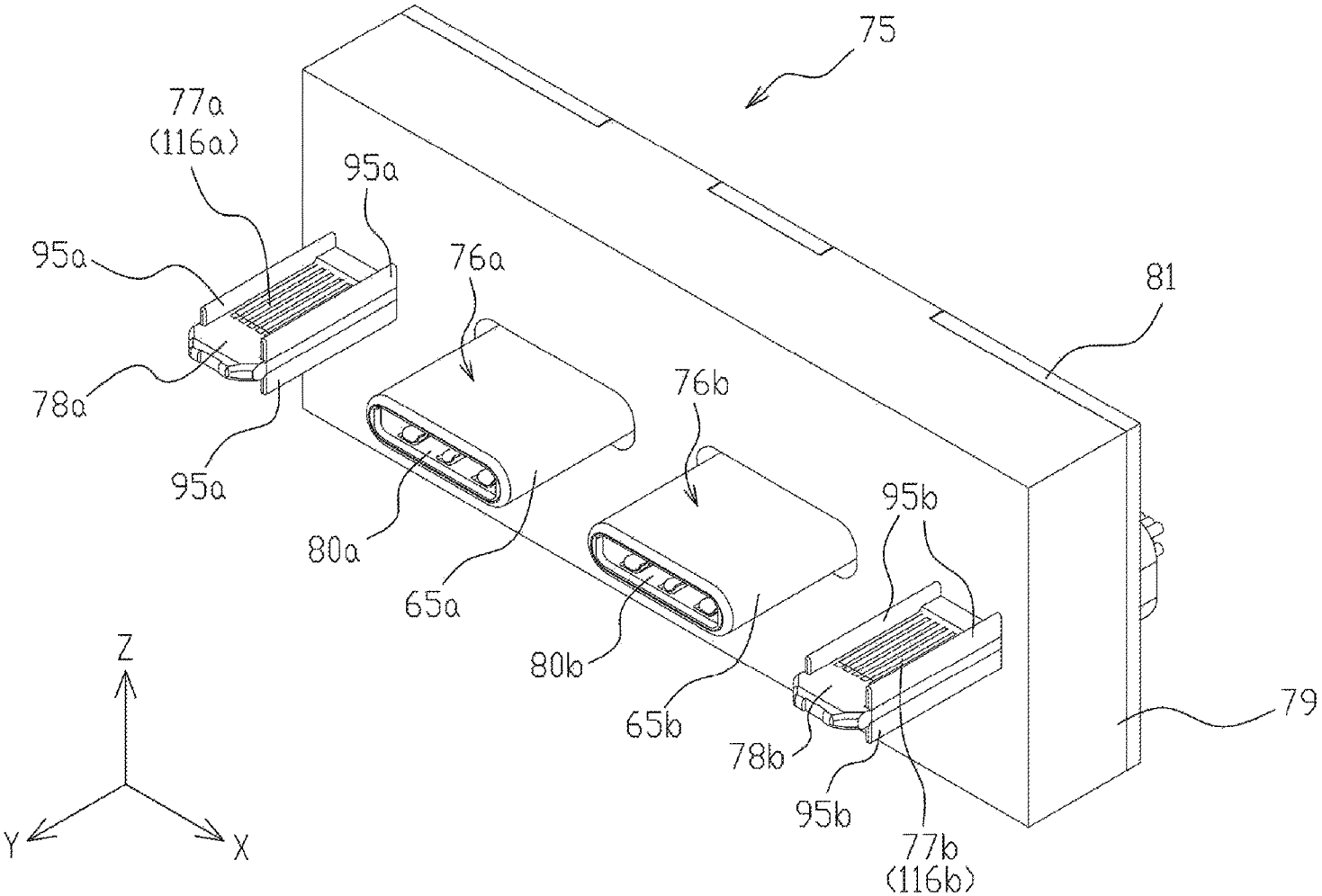
FIG. 9 is a perspective view showing an appearance of a plug docking connector according to a second embodiment.
Figure 10:
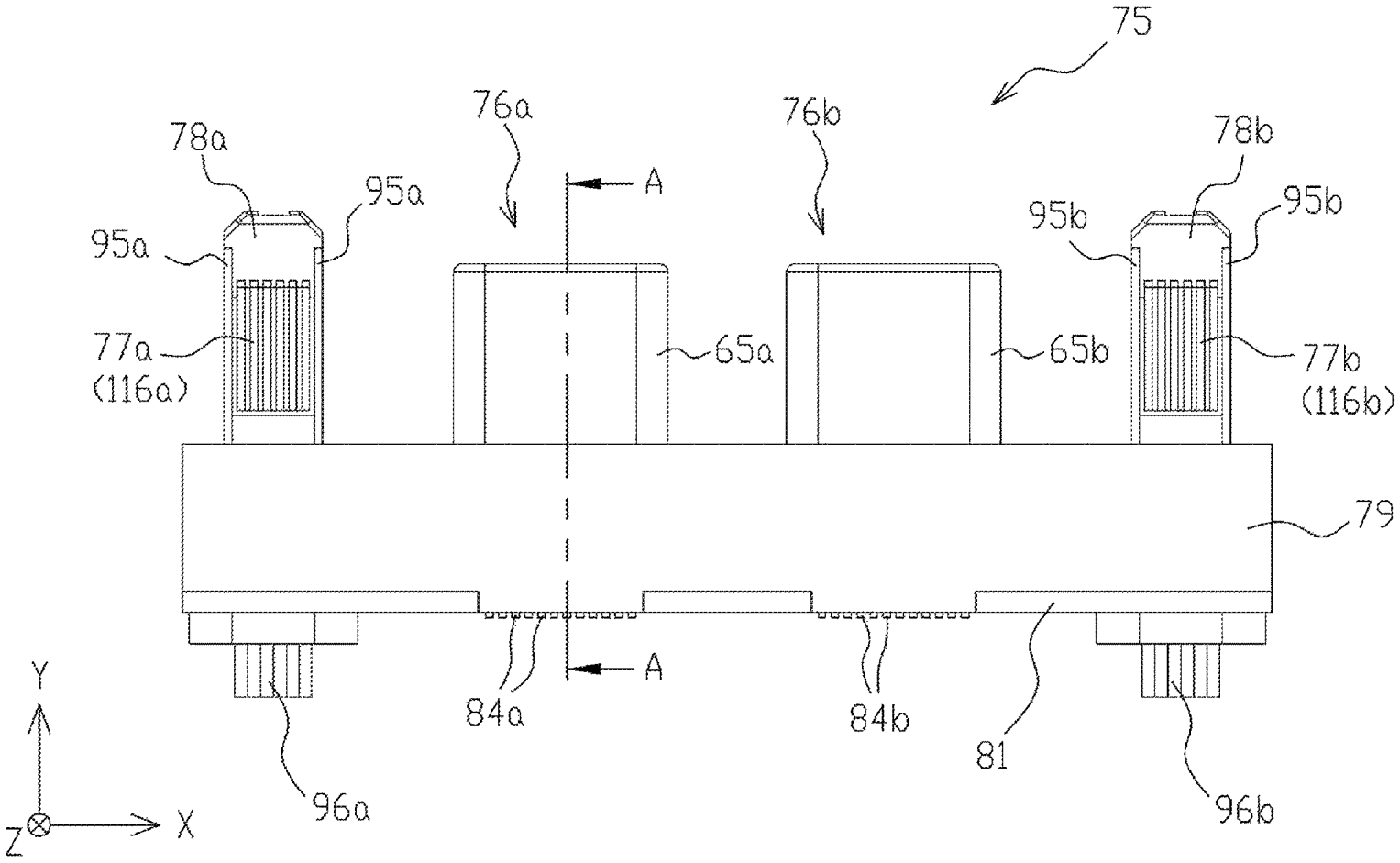
FIG. 10 is a bottom plan view showing the appearance of the plug docking connector according to the second embodiment.

Next, a docking connector according to a second embodiment of the present invention will be described with reference to the drawings. FIG. 9 is a perspective view showing an appearance of a plug docking connector as a plug unit according to the second embodiment, FIG. 10 is a bottom plan view showing the appearance of the plug docking connector according to the second embodiment. As shown in FIG. 9 and FIG. 10, a plug docking connector 75 includes a front cover 79 having two USB Type-C plug connectors (hereinafter, referred to simply as a plug connector) 76*a* and 76*b*, two additional plug connectors 77*a* and 77*b*, and two guide portions 78*a* and 78*b*, and a rear cover 81. The docking connector is a connector for connecting a portable terminal device with an external apparatus, which represents, in a broad sense, such a docking connector as incorporated into an apparatus main body, as housed in a housing or the like and as connected with an apparatus via a cable or the like, or other.

Additionally, in the following, with an XYZ orthogonal coordinate system set as shown in FIG. 9, description will be made of a positional relationship and the like of each member with reference to the orthogonal coordinate system. An X axis is set to be parallel to a direction in which the two plug connectors 76*a* and 76*b* are arranged. A Y axis is set to be parallel to a direction in which the plug docking connector 75 is docked with a receptacle docking connector 73 (see FIG. 15). A Z axis is set to be in a direction orthogonal to an YZ plane. Additionally, a side of the plug connector 76*b* is set to be a +X direction and a side of the plug connector 76*a* is set to be a −X direction, and a direction in which the plug docking connector 75 is docked with the receptacle docking connector is set to be a +Y direction and a direction in which the plug docking connector 75 is pulled out from the receptacle docking connector is set to be a −Y direction.

Figure 11:
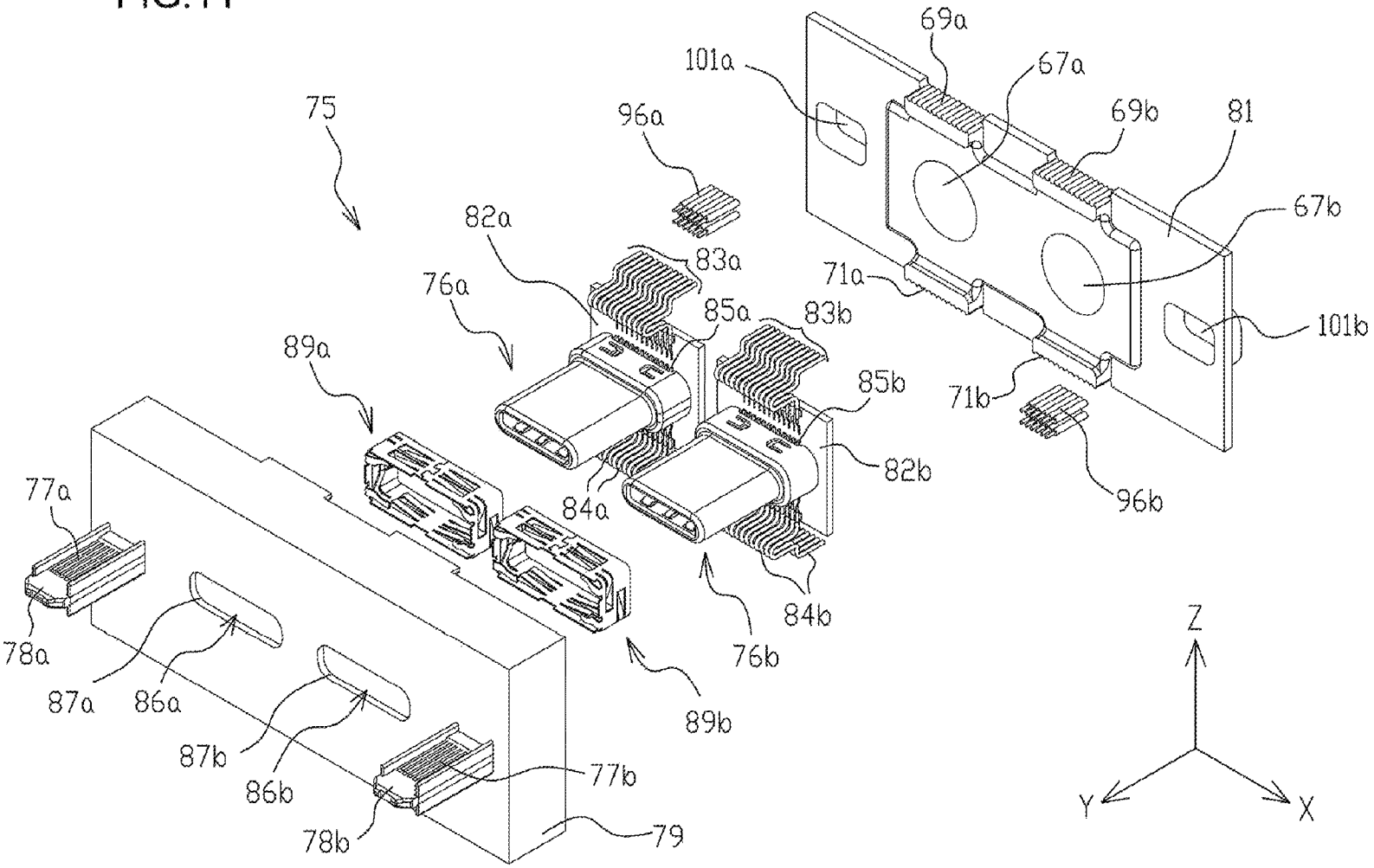
FIG. 11 is an exploded view showing a configuration of the plug docking connector according to the second embodiment.
Figure 12:
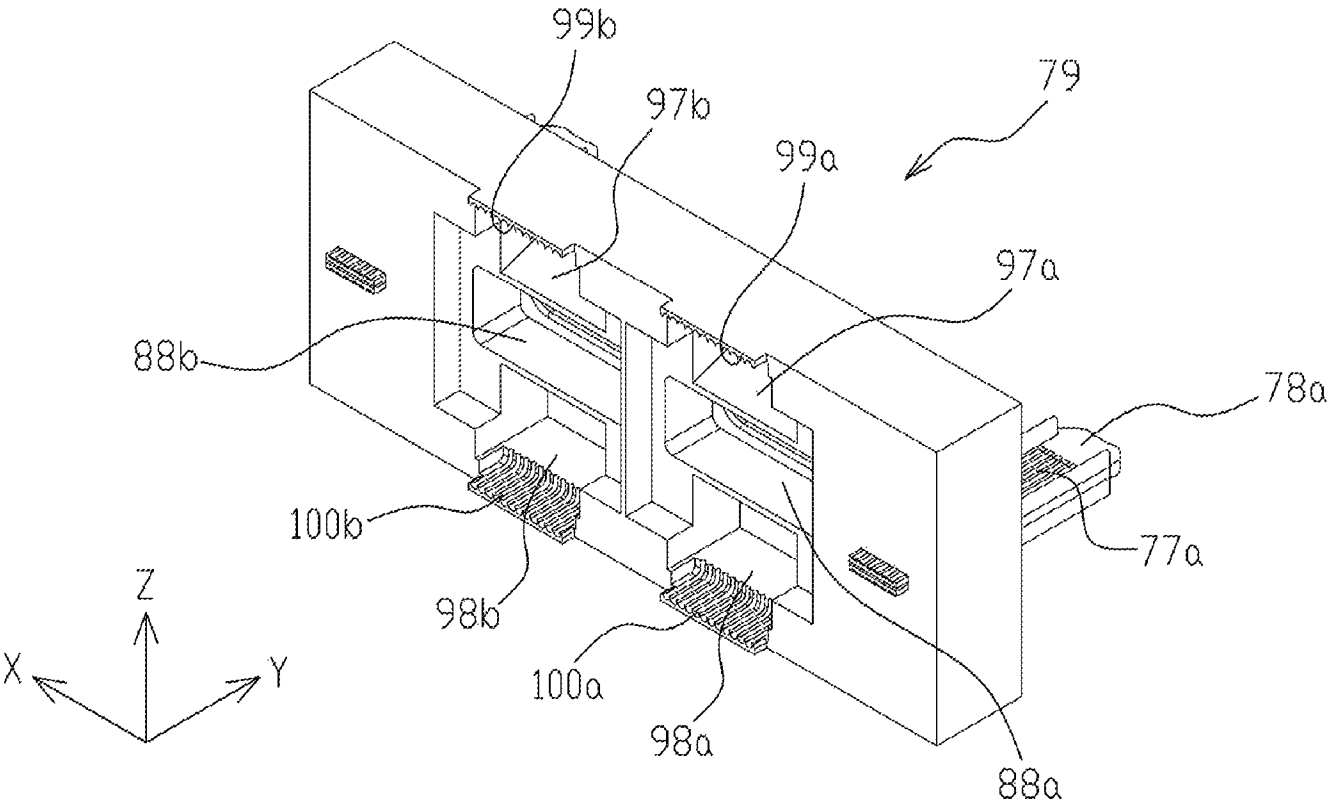
FIG. 12 is a perspective view showing an appearance of a front cover according to the second embodiment.

FIG. 11 is an exploded view showing a configuration of the plug docking connector 75, and FIG. 12 is a perspective view showing an appearance of the front cover 79 seen from the −Y direction. As shown in FIG. 9 to FIG. 12, the front cover 79 functions as a cover which covers the plug connectors 76*a* and 76*b*.

When docking with the receptacle docking connector 73 including two USB Type-C receptacle connectors (hereinafter, referred to simply as receptacle connectors) 113*a* and 113*b* (see FIG. 15), the front cover 79 includes the two guide portions 78*a* and 78*b* to be inserted into guide reception portions 102*a* and 102*b* (see FIG. 15) of the receptacle docking connector 73 before the plug connectors 76*a* and 76*b* fit in the two receptacle connectors 113*a* and 113*b* (see FIG. 15). The two guide portions 78*a* and 78*b* are formed integrally with the front cover 79, and the front cover 79 and the two guide portions 78*a* and 78*b* are formed of resin. The guide portion 78*a* is formed on the −X direction side of the plug connector 76*a*, and the guide portion 78*b* is formed on the +X direction side of the plug connector 76*b*.

The guide portion 78*a* has a member 95*a* with a high strength (metal in this embodiment) insert-molded therein. Similarly, the guide portion 78*b* has a member 95*b* with a high strength (metal in this embodiment) insert-molded therein. Insert-molding of the metals 95*a* and 95*b* in the guide portions 78*a* and 78*b* enables an increase in the guide portions 78*a* and 78*b* in strength, and enables breakage of the guide portions 78*a* and 78*b* to be prevented when the guide portions 78*a* and 78*b* are inserted into the guide reception portions 102*a* and 102*b* of the receptacle docking connector 73. The metals 95*a* and 95*b* can be incorporated into the guide portions 78*a* and 78*b* by fitting-in, embedding and the like other than by insert-molding.

Additionally, front end portions on the +Y direction side of the guide portions 78*a* and 78*b* protrude more in the +Y direction than front end portions on the +Y direction side of the plug connectors 76*a* and 76*b*. Specifically, the guide portions 78*a* and 78*b* protrude more than the plug connectors 76*a* and 76*b* to a side of an insertion direction (the +Y direction) in which the guide portions 78*a* and 78*b* are inserted into the guide reception portions 102*a* and 102*b* of the receptacle docking connector 73. Accordingly, when the plug docking connector 75 docks with the receptacle docking connector 73, the guide portions 78*a* and 78*b* are inserted into the guide reception portions 102*a* and 102*b* of the receptacle docking connector 73 before the plug connectors 76*a* and 76*b* fit in the receptacle connectors 113*a* and 113*b*.

Additionally, a width W (mm) of each of the guide portions 78*a* and 78*b* in a direction (Z direction) orthogonal to a direction in which the plug connectors 76*a* and 76*b* are aligned is equal to or more than an internal diameter width D (mm) in the Z direction of an internal diameter of each of the receptacle connectors 113*a* and 113*b*. The width W (mm) of each of the guide portions 78*a* and 78*b* preferably satisfies D□W□(D+0.6) and more preferably satisfies D□W□(D+1). Accordingly, when the plug docking connector 75 docks with the receptacle docking connector 73, erroneous insertion of the guide portions 78*a* and 78*b* into the receptacle connectors 113*a* and 113*b* can be prevented.

Additionally, the guide portion 78*a* has the additional plug connector 77*a* arranged therein, i.e., incorporated, and the additional plug connector 77*a* includes a plurality of contacts 116*a* as shown in FIG. 10. The contacts 116*a* each have a connection surface which connects with a connection terminal 108*a* of a contact 107*a* of an additional receptacle connector 103*a* (see FIG. 21). The connection surface is arranged on a plane substantially flush with a surface on the +Z side of the guide portion 78*a*. Additionally, the additional plug connector 77*a* also includes a plurality of contacts (not shown) on a surface on the −Z side of the guide portion 78*a*. The contacts not shown each have a connection surface which connects with the connection terminal 108*a* of the contact 107*a* of the additional receptacle connector 103*a* (see FIG. 21). The connection surface is arranged on a plane substantially flush with a surface on the −Z side of the guide portion 78*a*. The contacts 116*a* and contacts not shown of the additional plug connector 77*a* are electrically connected with cables 96*a* shown in FIG. 11.

Additionally, the guide portion 78*b* has the additional plug connector 77*b* arranged therein, i.e., incorporated, and the additional plug connector 77*b* includes a plurality of contacts 116*b* as shown in FIG. 10. The contacts 116*b* each have a connection surface which connects with a connection terminal (not shown) of a contact of an additional receptacle connector 103*b* (see FIG. 15). The connection surface is arranged on a plane substantially flush with a surface on the +Z side of the guide portion 78*b*. Additionally, the additional plug connector 77*b* also includes a plurality of contacts (not shown) on a surface on the −Z side of the guide portion 78*b*. The contacts not shown each have a connection surface which connects with a connection terminal (not shown) of a contact 107*b* of the additional receptacle connector 103*b*. The connection surface is arranged on a plane substantially flush with a surface on the −Z side of the guide portion 78*b*. The contacts 116*b* and contacts not shown of the additional plug connector 77*b* are electrically connected with cables 96*b* shown in FIG. 11.

Figure 15:
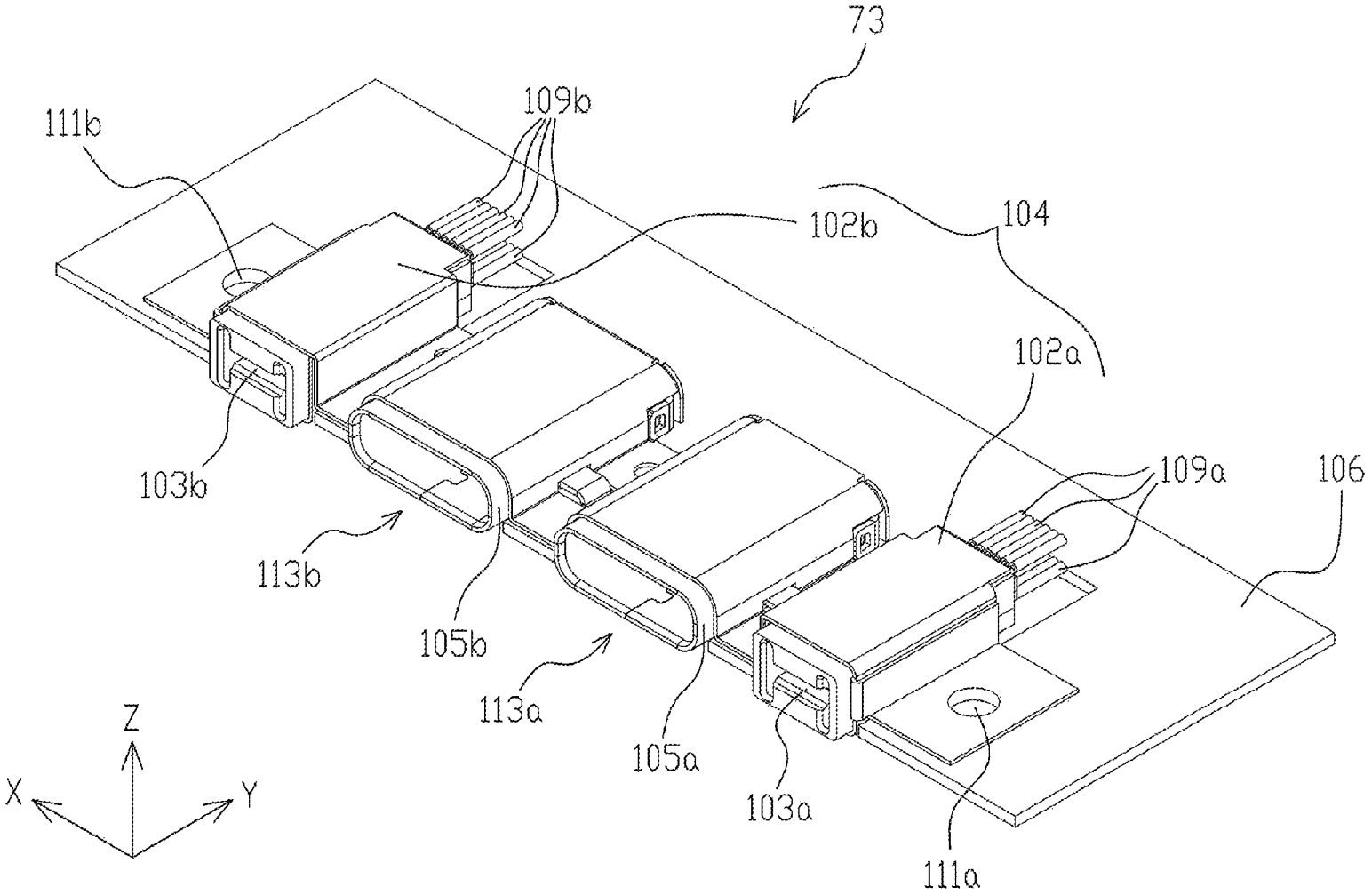
FIG. 15 is a perspective view showing an appearance of a receptacle docking connector according to the second embodiment.

Additionally, on the −X direction side between the guide portion 78*a* and the guide portion 78*b* of the front cover 79, an opening portion 86*a* is formed which covers the plug connector 76*a* and is for exposing a fit-in portion 80*a* at which the plug connector 76*a* fits in the receptacle connector 113*a* (see FIG. 15). Additionally, on the +X direction side between the guide portion 78*a* and the guide portion 78*b* of the front cover 79, an opening portion 86*b* is formed which covers the plug connector 76*b* and is for exposing a fit-in portion 80*b* at which the plug connector 76*b* fits in the receptacle connector 113*b* (see FIG. 15).

Additionally, in the front cover 79 (the rear of a surface on which the guide portions 78*a* and 78*b* are formed), as shown in FIG. 12, cable housing portions 97*a* and 98*a* are formed on the −X direction side, and cable housing portions 97*b* and 98*b* are formed on the +X direction side. The cable housing portion 97*a* is located on the +Z direction side to house a cable 83*a* (see FIG. 14). The cable housing portion 98*a* is located on the −Z direction side to house a cable 84*a* (see FIG. 14). The cable housing portion 97*b* is located on the +Z direction side to house a cable 83*b* (see FIG. 11). The cable housing portion 98*b* is located on the −Z direction side to house a cable 84*b* (see FIG. 11).

Further, in the front cover 79 (the rear of a surface on which the guide portions 78*a* and 78*b* are formed), as shown in FIG. 12, cable holding portions 99*a* and 100*a* are formed on the −X direction side, and cable holding portions 99*b* and 100*b* are formed on the +X direction side. The cable holding portion 99*a* is located on the +Z direction side and holds the cable 83*a* (see FIG. 11), together with a cable holding portion 69*a* of the rear cover 81 (see FIG. 11). The cable holding portion 100*a* is located on the −Z direction side and holds the cable 84*a* (see FIG. 11), together with a cable holding portion 71*a* of the rear cover 81 (see FIG. 11). The cable holding portion 99*b* is located on the +Z direction side and holds the cable 83*b* (see FIG. 11), together with a cable holding portion 69*b* of the rear cover 81 (see FIG. 11). The cable holding portion 100*b* is located on the −Z direction side and holds the cable 84*b* (see FIG. 11), together with a cable holding portion 71*b* of the rear cover 81 (see FIG. 11). The cable holding portions 99*a*, 99*b*, 100*a*, and 100*b* function as second holding portions which hold the cables 83*a*, 83*b*, 84*a*, and 84*b*, respectively, together with the cable holding portions 69*a*, 69*b*, 71*a*, and 71*b* of the rear cover 81 which will be described later. The second holding portion will be detailed later.

Additionally, between an outer wall portion of the plug connector 76*a*, i.e., a plug shell 65*a* which will be described later, and a wall portion 87*a* formed on the +Y direction side of the opening portion 86*a*, a predetermined space is formed such that on a surface on which the opening portion 86*a* is formed (ZX plane), the plug connector 76*a* can move relative to the front cover 79 (the rear cover 81 fixed to the front cover 79) as shown in FIG. 9. Similarly, between an outer wall portion of the plug connector 76*b*, i.e. a plug shell 65*b* which will be described later, and a wall portion 87*b* formed on the +Y direction side of the opening portion 86*b*, a predetermined space is formed such that on a surface on which the opening portion 86*b* is formed (ZX plane), the plug connector 76*b* can move relative to the front cover 79 (the rear cover 81 fixed to the front cover 79).

Figure 13:
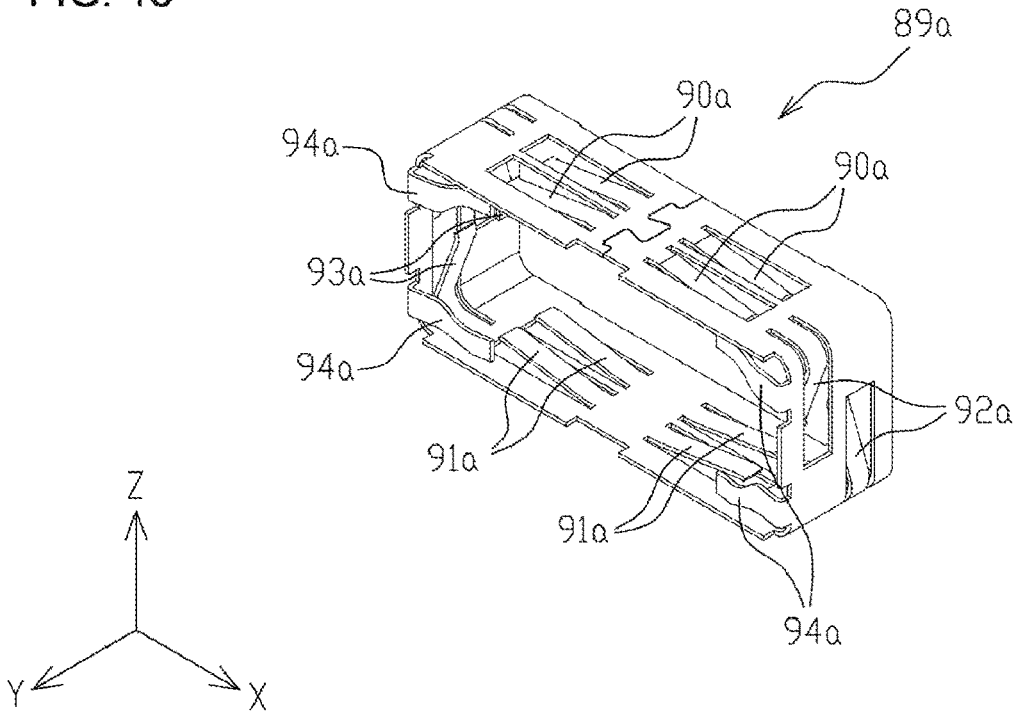
FIG. 13 is a view showing a configuration of a control portion according to the second embodiment.

Between the outer wall portion of the plug connector 76*a* and the front cover 79 (a wall portion 88*a* formed on the −Y direction side of the opening portion 86*a*), a control portion 89*a* is provided. FIG. 13 is a view showing a configuration of the control portion 89*a*. The control portion 89*a* is formed of a conductive member, e.g., metal, and on the +Z direction side of the control portion 89*a*, as shown in FIG. 13, four Z side elastic portions 90*a* are formed. Additionally, on the −Z direction side of the control portion 89*a*, four Z side elastic portions 91*a* are formed. The control portion 89*a* is incorporated into the opening portion 86*a*, and the Z side elastic portion 90*a* pushes the outer wall portion on the +Z direction side of the plug connector 76*a* toward the −Z direction by an elastic force. The outer wall portion on the +Z direction side of the plug connector 76*a* receives the elastic force of the Z side elastic portion 90*a*. The Z side elastic portion 91*a* pushes the outer wall portion on the −Z direction side of the plug connector 76*a* toward the +Z direction by an elastic force. The outer wall portion on the −Z side of the plug connector 76*a* receives an elastic force of the Z side elastic portion 91*a*.

The control portion 89*a* controls a position of the plug connector 76*a* in the Z direction relative to the opening portion 86*a* by using elastic forces of the Z side elastic portions 90*a* and 91*a*. For example, when a force in the −Z direction is applied to the plug connector 76*a*, the Z side elastic portion 90*a* extends in the −Z direction and the Z side elastic portion 91*a* contracts in the −Z direction. Accordingly, the plug connector 76*a* moves in the −Z direction within a predetermined space formed between the outer wall portion of the plug connector 76*a* and the wall portion 88*a*. When a force in the +Z direction is applied to the plug connector 76*a*, the Z side elastic portion 90*a* contracts in the +Z direction, and the Z side elastic portion 91*a* extends in the +Z direction. Accordingly, the plug connector 76*a* moves in the +Z direction within the predetermined space formed between the outer wall portion of the plug connector 76*a* and the wall portion 88*a*.

Additionally, on the +X direction side of the control portion 89*a*, as shown in FIG. 13, two X side elastic portions 92*a* are formed. Additionally, on the −X direction side of the control portion 89*a*, two X side elastic portions 93*a* are formed. The X side elastic portion 92*a* pushes the outer wall portion on the +X direction side of the plug connector 76*a* toward the −X direction by an elastic force. The outer wall portion on the +X direction side of the plug connector 76*a* receives the elastic force of the X side elastic portion 92*a*. The X side elastic portion 93*a* pushes the outer wall portion on the −X direction side of the plug connector 76*a* toward the +X direction by an elastic force. The outer wall portion on the −X direction side of the plug connector 76*a* receives the elastic force of the X side elastic portion 93*a*.

The control portion 89*a* controls a position of the plug connector 76*a* in the X direction relative to the opening portion 86*a* by using elastic forces of the X side elastic portions 92*a* and 93*a*. For example, when a force in the −X direction is applied to the plug connector 76*a*, the X side elastic portion 92*a* extends in the −X direction, and the X side elastic portion 93*a* contracts in the −X direction. Accordingly, the plug connector 76*a* moves in the −X direction within the predetermined space formed between the outer wall portion of the plug connector 76*a* and the wall portion 88*a*. When a force in the +X direction is applied to the plug connector 76*a*, the X side elastic portion 92*a* contracts in the +X direction, and the X side elastic portion 93*a* extends in the +X direction. Accordingly, the plug connector 76*a* moves in the +X direction within the predetermined space formed between the outer wall portion of the plug connector 76*a* and the wall portion 88*a*.

Additionally, on the +Y direction side of the control portion 89*a*, as shown in FIG. 13, four Y side elastic portions 94*a* are formed. The control portion 89*a* controls a posture of the plug connector 76*a* relative to the opening portion 86*a* by using the Y side elastic portion 94*a* and a convex portion 67*a* formed in the rear cover 81 (see FIG. 11). Posture control of the control portion 89*a* will be detailed later.

Additionally, between the outer wall portion of the plug connector 76*b* and the front cover 79 (a wall portion 88*b* formed on the −Y direction side of the opening portion 86*b*), a control portion 89*b* is provided. The control portion 89*b* is formed of a conductive member, e.g., metal, and is incorporated in the opening portion 86*b*. On the +Z direction side of the control portion 89*b*, four Z side elastic portions are formed which have the same function and effect as those of the Z side elastic portion 90*a* of the control portion 89*a*. Additionally, on the −Z direction side of the control portion 89*b*, four Z side elastic portions are formed which have the same function and effect as those of the Z side elastic portion 91*a* of the control portion 89*a*.

Additionally, on the +X direction side of the control portion 89*b*, two X side elastic portions are formed which have the same function and effect as those of the X side elastic portion 92*a* of the control portion 89*a*. Additionally, on the −X direction side of the control portion 89*b*, two X side elastic portions are formed which have the same function and effect as those of the X side elastic portion 93*a* of the control portion 89*a*. Additionally, on the +Y direction side of the control portion 89*b*, four Y side elastic portions are formed which have the same function and effect as those of the Y side elastic portion 94*a* of the control portion 89*a*. Since position control and posture control of the plug connector 76*b* of the control portion 89*b* are the same as the position control and the posture control of the plug connector 76*a* in the control portion 89*a*, no description will be made thereof.

Figure 14:
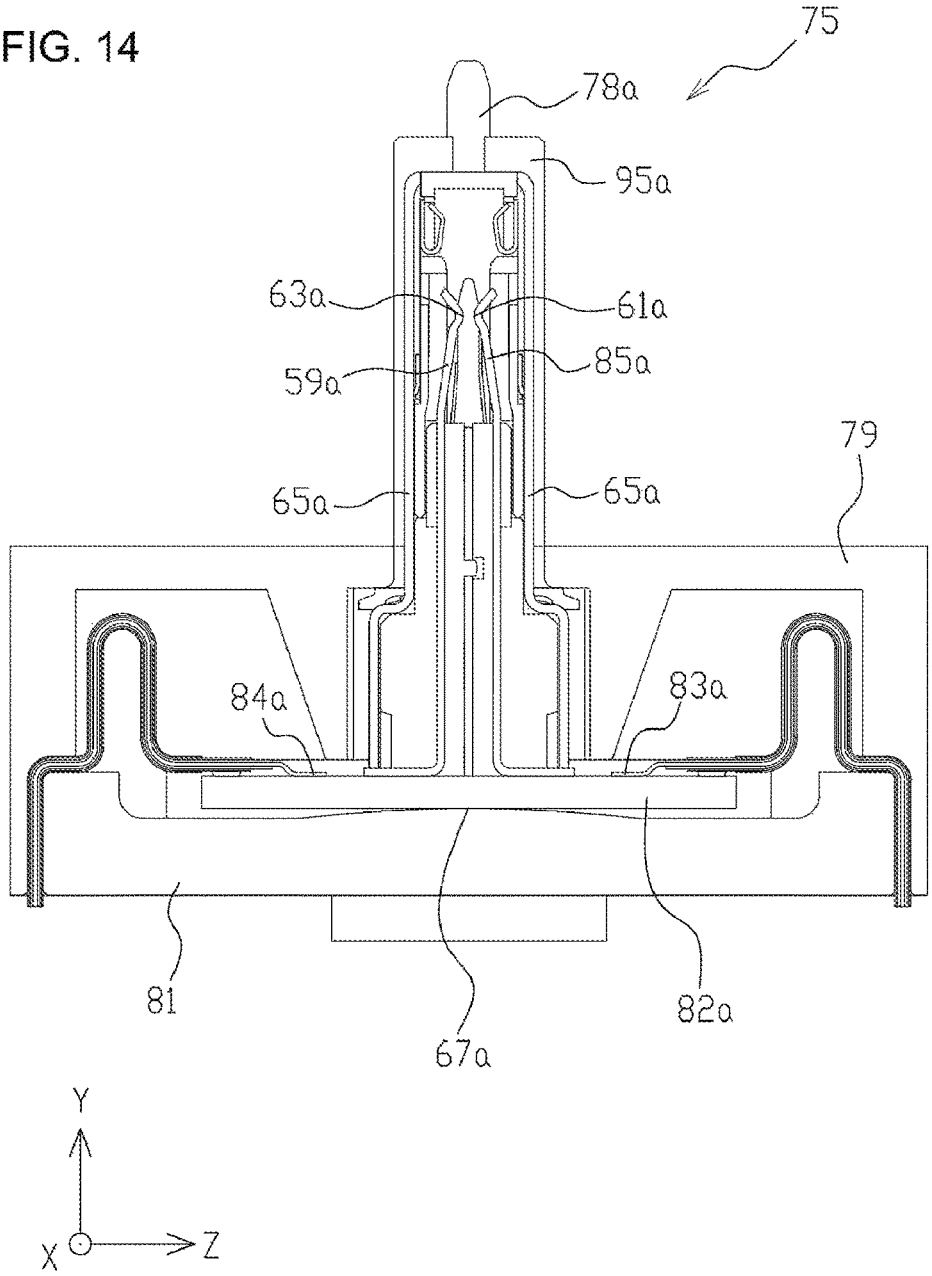
FIG. 14 is a sectional view showing a configuration of the plug docking connector according to the second embodiment.

Next, a configuration of the plug connector 76*a* will be described. FIG. 14 is a sectional view taken along A-A in FIG. 10. The plug connector 76*a* is mounted on a circuit board 82*a* as shown in FIG. 11 and FIG. 14. As shown in FIG. 14, the plug connector 76*a* includes a plurality of contacts 85*a* and a plurality of contacts 59*a* which connect with a plurality of contacts (not shown) of the receptacle connectors 113*a* and 113*b* (see FIG. 15), and the plug shell 65*a* covering the plurality of contacts 85*a* and 59*a*. Each of the plurality of contacts 85*a* is arranged on the +Z direction side of the plug connector 76*a*, and an end portion on the −Y direction side of the contact 85*a* is fixed to the circuit board 82*a* by soldering or the like. Additionally, each of the plurality of contacts 85*a* includes a contact portion 61*a* at an end portion thereof on the +Y direction side, the contact portion 61*a* for coming into contact with the contacts (not shown) of the receptacle connectors 113*a* and 113*b* (see FIG. 15). Each of the plurality of contacts 59*a* is arranged on the −Z direction side of the plug connector 76*a*, and an end portion on the −Y direction side of the contact 59*a* is fixed to the circuit board 82*a* by soldering or the like. Additionally, each of the plurality of contacts 59*a* includes a contact portion 63*a* at an end portion thereof on the +Y direction side, the contact portion 63*a* for coming into contact with the contacts (not shown) of the receptacle connectors 113*a* and 113*b*.

Additionally, on the +Z direction side of the circuit board 82*a*, one end of each of the plurality of cables 83*a* is fixed by soldering or the like. Each of the plurality of cables 83*a* is electrically connected with each of the plurality of contacts 85*a* arranged on the +Z direction side of the plug connector 76*a* via the circuit board 82*a*. Additionally, to the −Z direction side of the circuit board 82*a*, one end of each of the plurality of cables 84*a* is fixed by soldering or the like. Each of the plurality of cables 84*a* is electrically connected with each of the plurality of contacts 59*a* arranged on the −Z direction side of the plug connector 76*a* via the circuit board 82*a*.

Next, a configuration of the plug connector 76*b* will be described. The plug connector 76*b* is mounted on a circuit board 82*b* as shown in FIG. 11. Additionally, the plug connector 76*b* includes a plurality of contacts not shown and the plug shell 65*b* (see FIG. 9). Configurations of these contacts and the shell are line-symmetrically the same as those of the plurality of contacts 85*a* and 59*a* and the plug shell 65*a*, i.e., with respect to a center line in the Y axis direction of the plug docking connector 75. Additionally, on the +Z direction side of the circuit board 82*b*, one end of each of the plurality of cables 83*b* is fixed by soldering or the like. Each of the plurality of cables 83*b* is electrically connected with each of a plurality of contacts 85*b* arranged on the +Z direction side of the plug connector 76*b*. Additionally, on the −Z direction side of the circuit board 82*b*, one end of the plurality of cables 84*b* is fixed by soldering or the like. Each of the plurality of cables 84*b* is electrically connected with each of a plurality of contacts (not shown) arranged on the −Z direction side of the plug connector 76*b*.

Here, the circuit boards 82*a* and 82*b* on which the plug connectors 76*a* and 76*b* are mounted function as first holding portions which hold one ends of the plurality of cables 83*a* and 83*b*, respectively, because one ends of the plurality of cables 83*a* and 83*b* are fixed to the circuit boards 82*a* and 82*b*, respectively. The first holding portion will be detailed later.

Next, a configuration of the rear cover 81 will be described. As shown in FIG. 9, the rear cover 81 is attached and fixed to the front cover 79 to support the plug connectors 76*a* and 76*b* from the −Y direction side. As shown in FIG. 11, on the −X direction side of the rear cover 81, an opening portion 101*a* is formed for leading the cable 96*a* from a space formed between the front cover 79 and the rear cover 81 to the outside. The cable 96*a* is fixed in the opening portion 101*a* by an adhesive not shown or the like. Additionally, on the +X direction side of the rear cover 81, an opening portion 101*b* is formed for leading the cable 96*b* from the space formed between the front cover 79 and the rear cover 81 to the outside. The cable 96*b* is fixed in the opening portion 101*b* by an adhesive not shown or the like.

Additionally, on a surface on the +Y direction side of the rear cover 81, the convex portion 67*a* as a part of the configuration of the control portion 89*a*, and a convex portion 67*b* as a part of the configuration of the control portion 89*b* are formed. The two convex portions 67*a* and 67*b* each have a convex surface on the +Y direction side, and the convex portion 67*a* is arranged on the +X direction side of the rear cover 81 to support the plug connector 76*a* in the +Y direction. The convex portion 67*b* is arranged on the −X direction side of the rear cover 81 to support the plug connector 76*b* in the +Y direction.

Using the Y side elastic portion 94*a* (see FIG. 13) and the convex portion 67*a* (see FIG. 11), the control portion 89*a* controls a posture of the plug connector 76*a* relative to the opening portion 86*a*, i.e. an inclination relative to the Y axis direction. For example, applying, to the plug connector 76*a*, a force in a direction slanting relative to the Y axis direction changes a direction in which the convex portion 67*a* supports the plug connector 76*a* and an elastic force of the Y side elastic portion 94*a*. Then, the posture of the plug connector 76*a* changes to a direction in which a force is applied in a predetermined space formed between the plug shell 65*a* and the wall portion 87*a*. Specifically, the plug connector 76*a* slants relative to a surface on which the opening portion 86*a* is formed. The Y side elastic portion 94*a* arranged on the side to which the plug connector 76*a* slants functions as a correction portion which uses an elastic force thereof to push the plug connector 76*a*, thereby correcting an inclination of the plug connector 76*a*. When the force applied to the plug connector 76*a* is released, by the elastic force of the Y side elastic portion 94*a*, the plug connector 76*a* returns to a posture as of before the force is applied to the plug connector 76*a*.

Additionally, in the rear cover 81, on a side portion on the +Z direction side, the cable holding portions 69*a* and 69*b* are formed, and on a side portion on the −Z direction side, the cable holding portions 71*a* and 71*b* are formed as shown in FIG. 11. The cable holding portion 69*a* is located on the −X direction side to support the cable 83*a* together with the cable holding portion 99*a* of the front cover 79 (see FIG. 12). The cable holding portion 69*b* is located on the +X direction side to support the cable 83*b* together with the cable holding portion 99*b* of the front cover 79 (see FIG. 12). The cable holding portion 71*a* is located on the −X direction side to hold the cable 84*a* together with the cable holding portion 100*a* of the front cover 79 (see FIG. 12). The cable holding portion 71*b* is located on the +X direction side to hold the cable 84*b* together with the cable holding portion 100*b* (see FIG. 12). The cable holding portions 69*a*, 69*b*, 71*a*, and 71*b* function as the second holding portions which hold the cables 83*a*, 83*b*, 84*a*, and 84*b*, together with the cable holding portions 99*a*, 99*b*, 100*a*, and 100*b* of the front cover 79 respectively.

In the second embodiment, the cable 83*a* (see FIG. 11) has a flexible portion which follows movement of the plug connector 76*a*, the flexible portion being housed in the cable housing portion 97*a* (see FIG. 12) between the circuit board 82*a* (see FIG. 11) as the first holding portion and the cable holding portion 99*a* (see FIG. 12) and the cable holding portion 69*a* (see FIG. 11) as the second holding portions. The circuit board 82*a* is fixed to the plug connector 76*a* and functions as the first holding portion which holds one end of the cable 83*a* as a flexible portion. The cable holding portion 99*a* of the front cover 79 and the cable holding portion 69*a* of the rear cover 81 are provided at the front cover 79 and the rear cover 81 as the covers, respectively, and function as the second holding portions which hold the other ends of the cables 83*a* as the flexible portion.

Provision of the flexible portion, the first holding portion and the second holding portion allows the plug connector 76*a* to move relative to the front cover 79 and the rear cover 81 without being restricted by other member. The flexible portion need not necessarily to be the cable 83*a* and can be the contact 85*a* of the plug connector 76*a*, for example. Additionally, the first holding portion need not to be the circuit board 82*a* and can be the plug connector 76*a*, for example.

Figure 16:
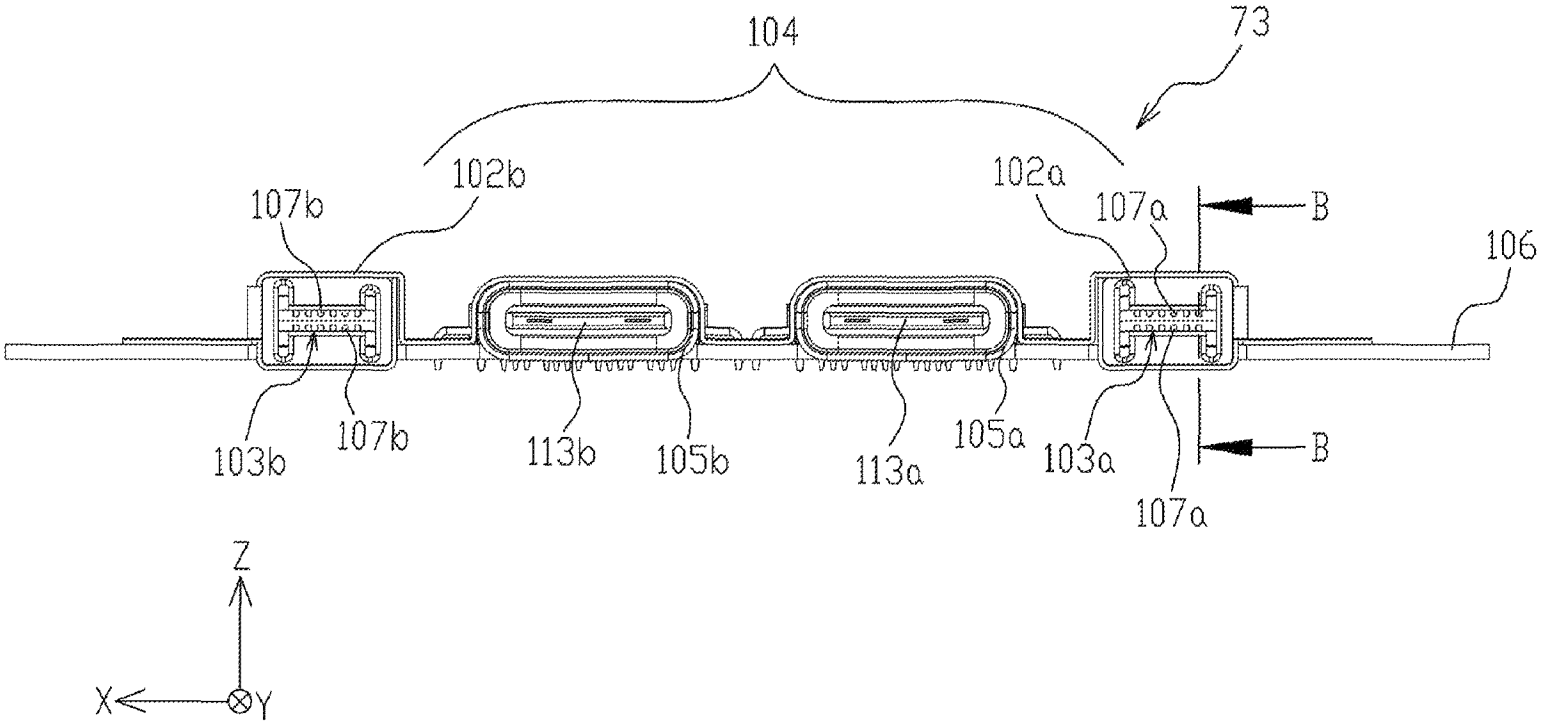
FIG. 16 is a front view showing the appearance of the receptacle docking connector according to the second embodiment.
Figure 17:
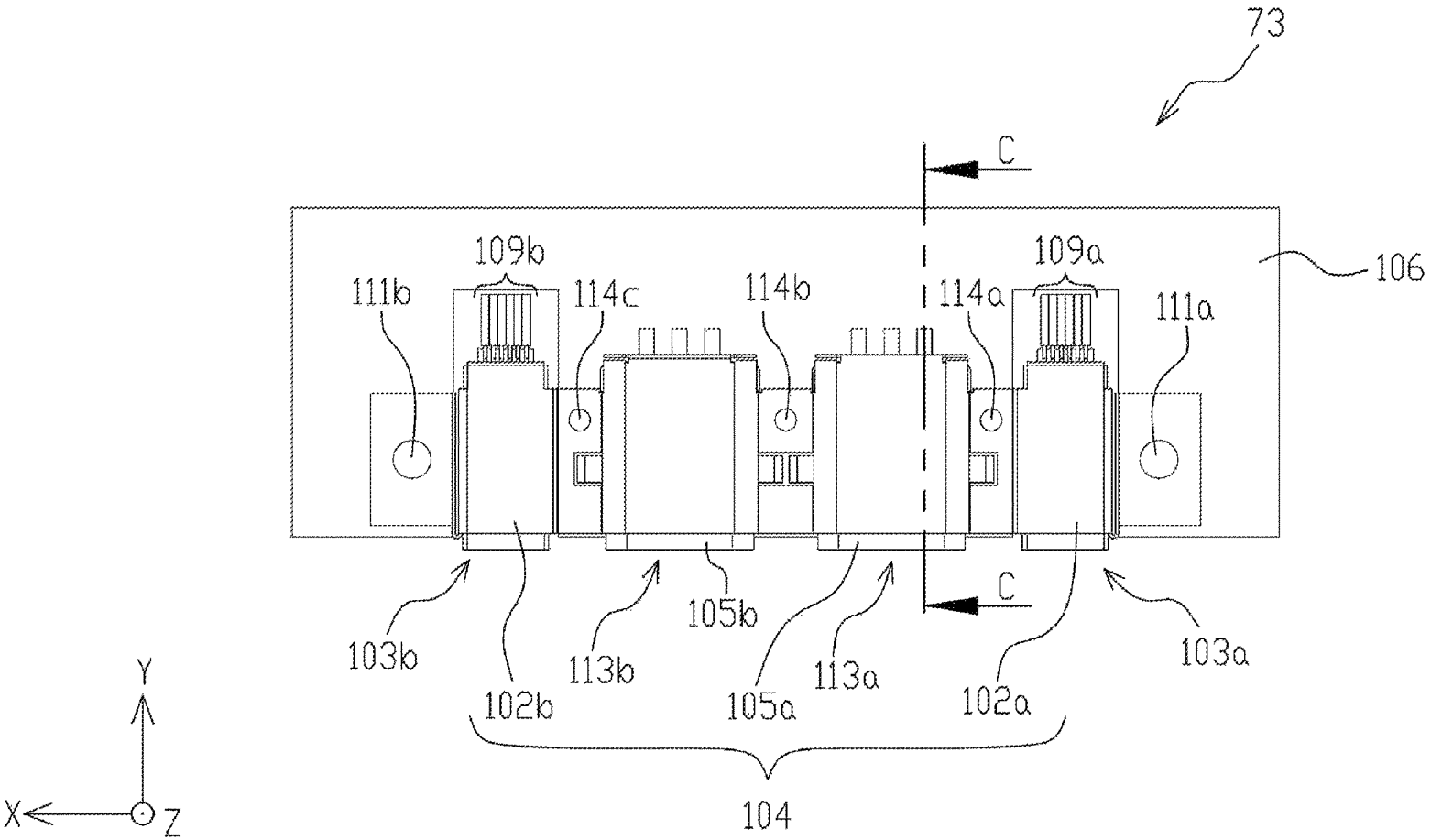
FIG. 17 is a plan view showing the appearance of the receptacle docking connector according to the second embodiment.
Figure 18:
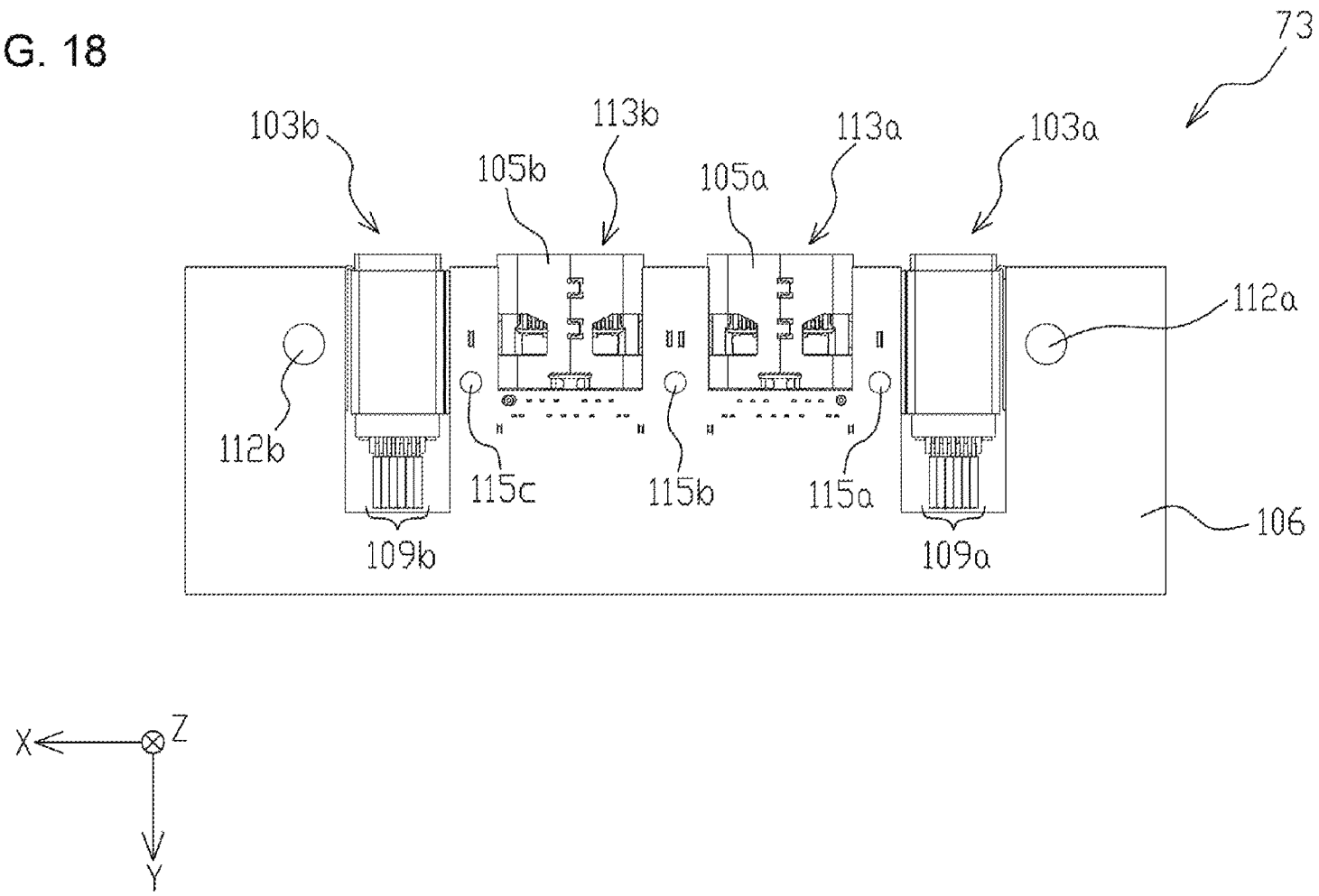
FIG. 18 is a bottom plan view showing the appearance of the receptacle docking connector according to the second embodiment.

Next, description will be made of a docking connector on a receptacle side (hereinafter, referred to as a receptacle docking connector) as a receptacle unit according to the second embodiment of the present invention with reference to the drawings. FIG. 15 is a perspective view showing an appearance of a receptacle docking connector according to the second embodiment, FIG. 16 is a front view showing the appearance of the receptacle docking connector according to the second embodiment, FIG. 17 is a plan view showing the appearance of the receptacle docking connector according to the second embodiment, and FIG. 18 is a bottom plan view showing the appearance of the receptacle docking connector according to the second embodiment. The receptacle docking connector 73 is mounted on a portable terminal device (electronic apparatus) such as a tablet type PC or the like, and as shown in FIG. 15, includes a guide shell 104 having the two receptacle connectors 113*a* and 113*b*, the two additional receptacle connectors 103*a* and 103*b*, and the two guide reception portions 102*a* and 102*b*.

Figure 19:
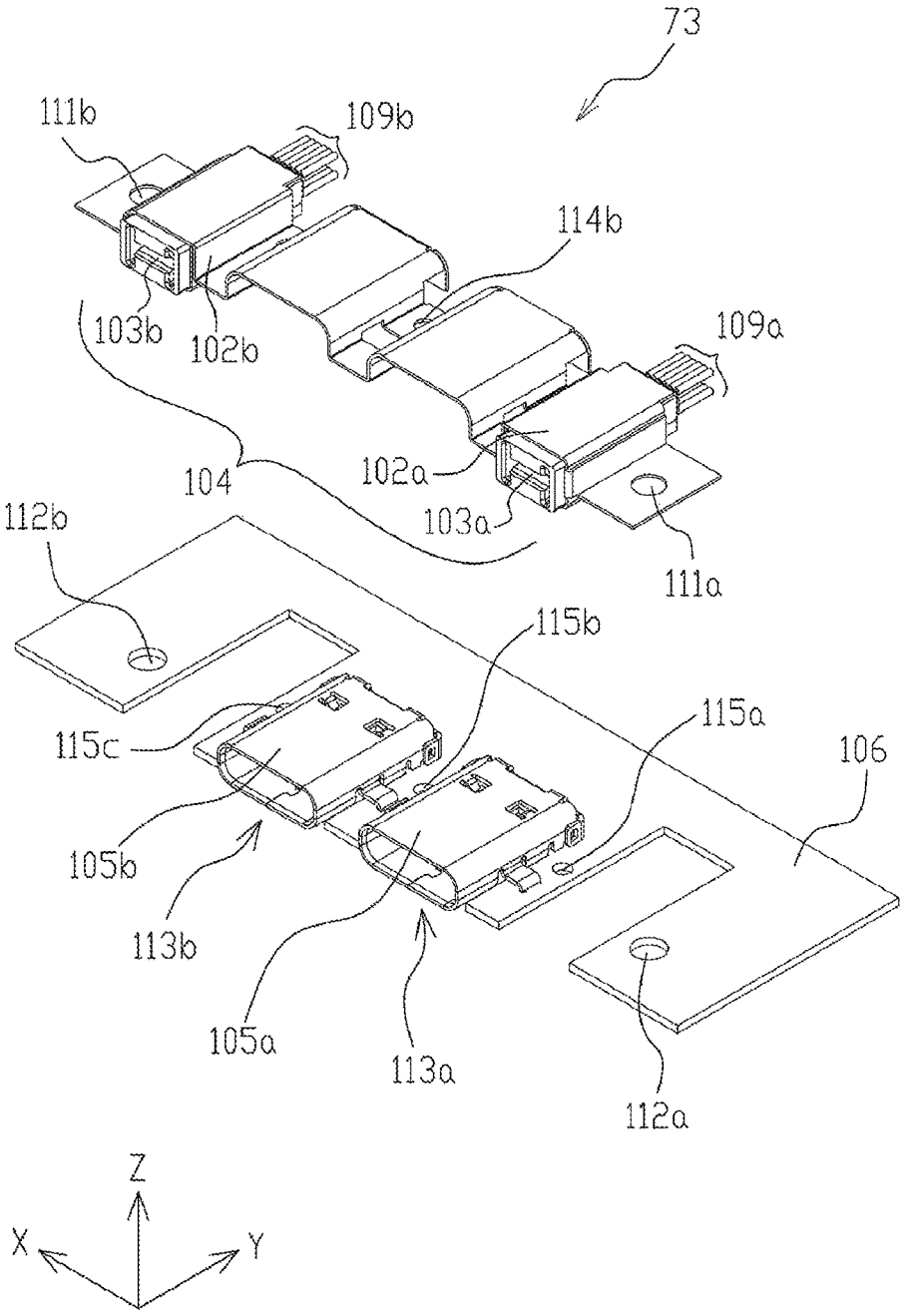
FIG. 19 is an exploded view showing a configuration of the receptacle docking connector according to the second embodiment.
Figure 20:
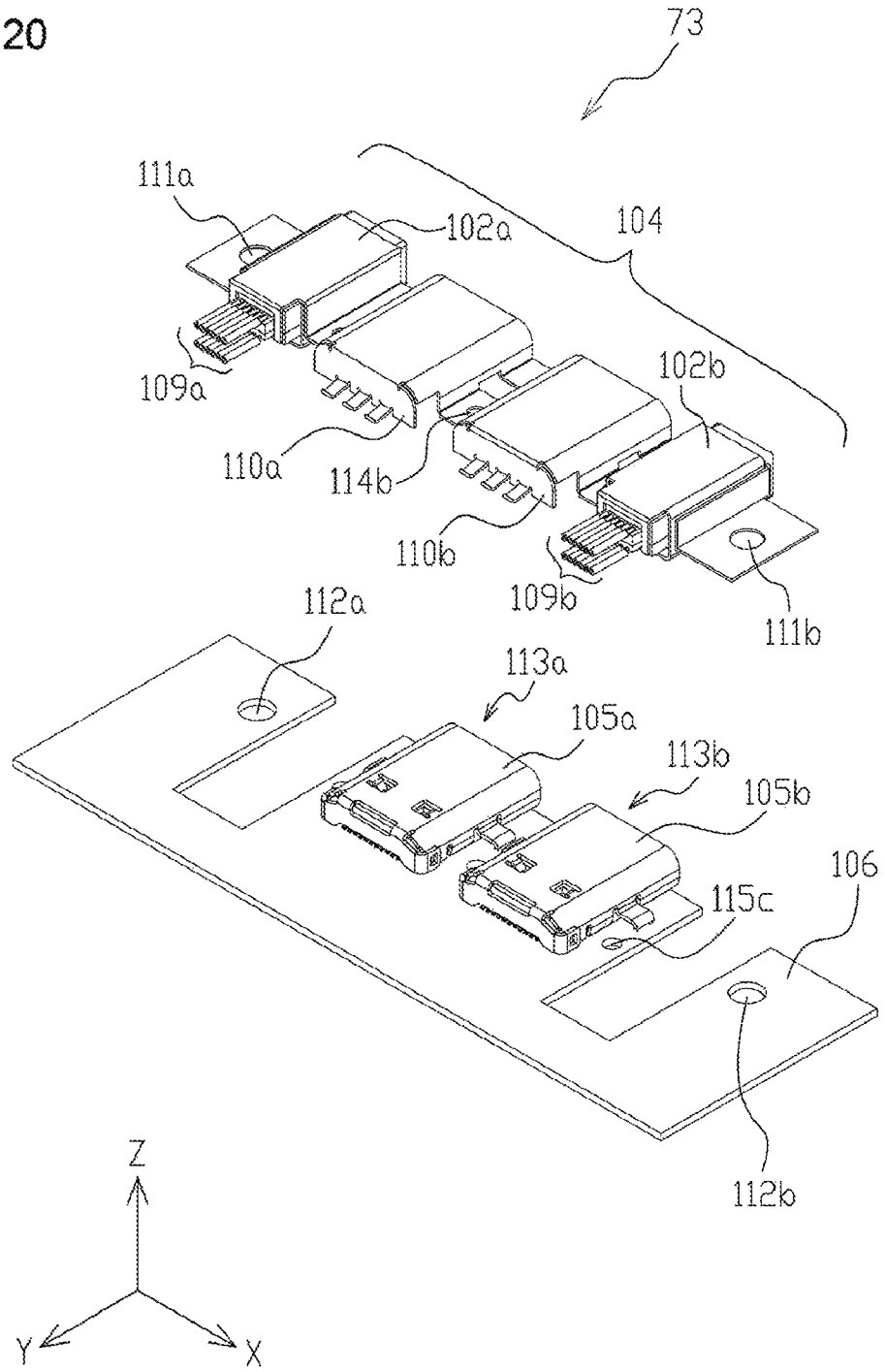
FIG. 20 is an exploded view showing the configuration of the receptacle docking connector according to the second embodiment.

FIG. 19 and FIG. 20 are exploded views for explaining a configuration of the receptacle docking connector 73, FIG. 19 as a perspective view seen from the front side and FIG. 20 as a perspective view seen from the back side. The receptacle connector 113*a* includes a receptacle shell 105*a* which engages with the plug connector 76*a* (see FIG. 9) and as shown in FIG. 16, covers a contact and the like (not shown) provided in the receptacle connector 113*a*. The receptacle connector 113*b* includes a receptacle shell 105*b* which engages with the plug connector 76*b* (see FIG. 9) and as shown in FIG. 16, covers a contact and the like (not shown) provided in the receptacle connector 113*b*.

The receptacle connectors 113*a* and 113*b* are mounted on a mounting surface (a surface on the +Z direction side) of a board 106 such that an engagement direction (Y direction) as a direction of engagement with the plug connectors 76*a* and 76*b* and the mounting surface are parallel to each other. Additionally, the receptacle connectors 113*a* and 113*b* are mounted on the board 106 individually. Specifically, the receptacle connector 113*a* is mounted on the board 106 independently of the receptacle connector 113*b*. Although in the second embodiment, the two receptacle connectors 113*a* and 113*b* are provided, three or more receptacle connectors can be provided. Additionally, when three or more receptacle connectors are provided, at least one receptacle connector of the three or more receptacle connectors is mounted on the board 106 independently of at least one other receptacle connector. For example, when three receptacle connectors are provided, each receptacle connector is individually mounted on the board 106, or two receptacle connectors are integrally mounted on the board 106 and one receptacle connector is mounted on the board 106 independently of the other two receptacle connectors.

Figure 21:
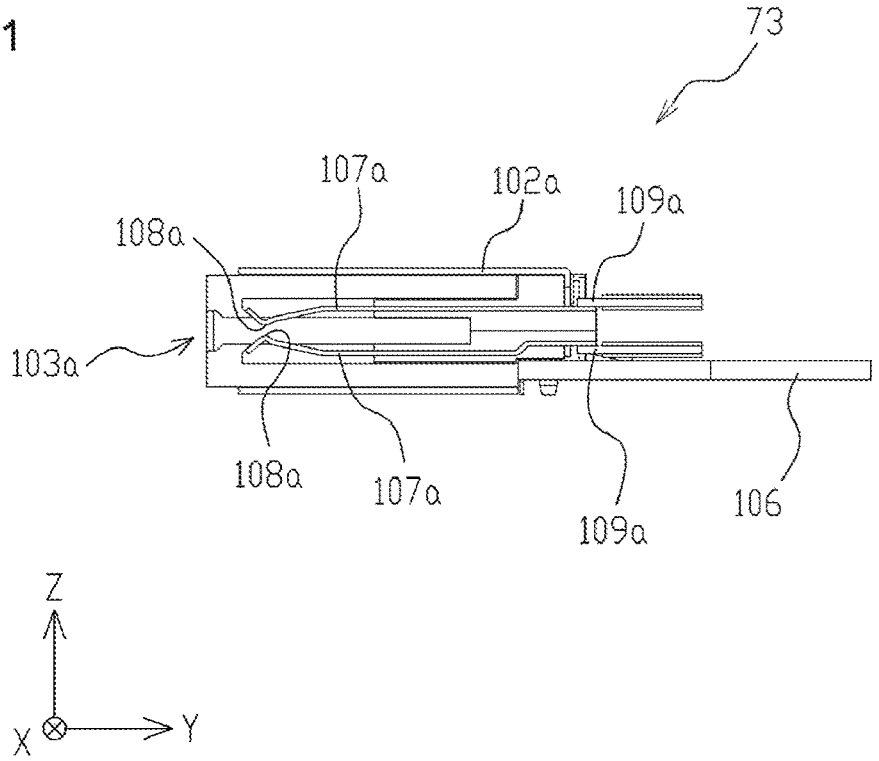
FIG. 21 is a sectional view showing the configuration of the receptacle docking connector according to the second embodiment.

The additional receptacle connector 103*a* is located on the −X direction side of the receptacle docking connector 73 and is arranged within the guide reception portion 102*a* as shown in FIG. 15. FIG. 21 is a sectional view taken along B-B in FIG. 16. The additional receptacle connector 103*a* includes a plurality (12 in the second embodiment) of contacts 107*a* as shown in FIG. 16 and FIG. 21. At one end portion of the contact 107*a*, the connection terminal 108*a* as an elastic body is formed which connects with the contact 116*a* and a contact not shown of the additional plug connector 77*a*, as shown in FIG. 21. The other end portion of the contact 107*a* is electrically connected with a wire 109*a* as shown in FIG. 21.

The additional receptacle connector 103*b* is located on the +X direction side of the receptacle docking connector 73 and is arranged within the guide reception portion 102*b* as shown in FIG. 15. The additional receptacle connector 103*b* includes a plurality (12 in the second embodiment) of contacts 107*b*. At one end portion of the contact 107*b*, a connection terminal (not shown) as an elastic body is formed which connects with the contact 116*b* and a contact not shown of the additional plug connector 77*b* similarly to the contact 107*a* of the additional receptacle connector 103*a*. The other end portion of the contact 107*b* is electrically connected with a wire 109*b*.

In the above second embodiment, description has been made of a case where the plug connector 76*a* is engaged with the receptacle connector 113*a* and the plug connector 76*b* is engaged with the receptacle connector 113*b*. In this case, the additional receptacle connector 103*a* engages with the additional plug connector 77*a*, and the additional receptacle connector 103*b* engages with the additional plug connector 77*b*. However, the plug docking connector 75 and the receptacle docking connector 73 according to the second embodiment are reversible connectors, and also the receptacle connector 113*a* can be engaged with the plug connector 76*b* and the receptacle connector 113*b* can be engaged with the plug connector 76*a*. In this case, the additional receptacle connector 103*a* and the additional plug connector 77*b* engage with each other and the additional receptacle connector 103*b* engages with the additional plug connector 77*a*.

Next, a configuration of the guide shell 104 will be described. The guide shell 104 is formed of metal or the like and includes the guide reception portion 102*a* and the additional receptacle connector 103*a* arranged in the −X direction side, and the guide reception portion 102*b* and the additional receptacle connector 103*b* arranged in the +X direction side. Specifically, the guide reception portions 102*a* and 102*b* integrally formed. As shown in FIG. 15, the guide shell 104 covers outer circumferences on the +Z direction side of the receptacle connectors 113*a* and 113*b*.

Additionally, as shown in FIG. 20, the guide shell 104 includes supporting portions 110*a* and 110*b* which support the receptacle connectors 113*a* and 113*b* in the insertion direction (the +Y direction) in which the guide portions 78*a* and 78*b* (see FIG. 9) are inserted into the guide reception portions 102*a* and 102*b*. As shown in FIG. 20, the guide shell 104 (the supporting portions 110*a* and 110*b*) covers the outer circumferences on the +Y direction side of the receptacle connectors 113*a* and 113*b*. The supporting portions 110*a* and 110*b* receive a force applied to the +Y direction when the guide portions 78*a* and 78*b* are inserted into the guide reception portions 102*a* and 102*b*. Additionally, the supporting portions 110*a* and 110*b* prevent coming-off of the receptacle connectors 113*a* and 113*b* from the board 106.

Additionally, the guide shell 104 is provided with a hole 111*a* for allowing a screw to pass to the −X direction side in the vicinity of the additional receptacle connector 103*a*, and a hole 111*b* for allowing a screw to pass to the +X direction side in the vicinity of the additional receptacle connector 103*b*. Additionally, the guide shell 104 is provided with a hole 114*a* for allowing a screw to be inserted between the additional receptacle connector 103*a* and the receptacle connector 113*a*, a hole 114*b* for allowing a screw to be inserted between the receptacle connector 113*a* and the receptacle connector 113*b*, and a hole 114*c* for allowing a screw to be inserted between the receptacle connector 113*b* and the additional receptacle connector 103*b*. The holes 111*a*, 111*b*, and 114*a* to 114*c* function as fixing portions for fixing the guide shell 104 to a casing of a portable terminal device. The guide shell 104 and the board 106 are screwed to the casing (not shown) of the portable terminal device by inserting a screw into the hole 111*a* and a hole 112*a* formed in the board 106, inserting a screw into the hole 111*b* and a hole 112*b* formed in the board 106, inserting a screw into the hole 114*a* and a hole 115*a* formed in the board 106, inserting a screw into the hole 114*b* and a hole 115*b* formed in the board 106, and inserting a screw into the hole 114*c* and a hole 115*c* formed in the board 106. Specifically, the guide shell 104 is fixed to the casing together with the board 106 after the receptacle connectors 113*a* and 113*b* are mounted on the board 106. At this time, the guide shell 104 is attached to the casing of the portable terminal device from a position (the +Z direction side) opposed to the mounting surface (the surface on the +Z direction side) of the board 106.

Figure 22:
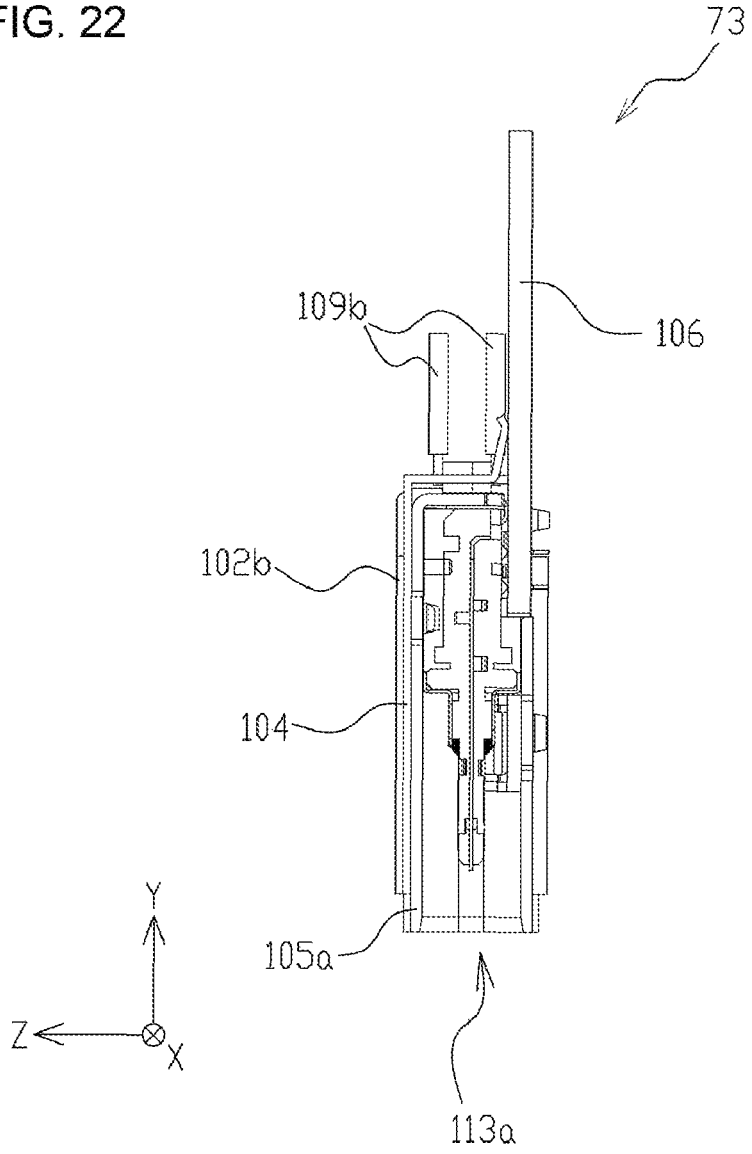
FIG. 22 is a sectional view showing the configuration of the receptacle docking connector according to the second embodiment.

FIG. 22 is a sectional view taken along C-C in FIG. 17. The guide shell 104 and the receptacle shell 105*a* of the receptacle connector 113*a* electrically conduct with each other as shown in FIG. 22. Similarly, the guide shell 104 and the receptacle shell 105*b* of the receptacle connector 113*b* electrically conduct with each other.

With the plug docking connector 75 according to the second embodiment provided with the guide portions 78*a* and 78*b*, the guide portions 78*a* and 78*b* are inserted into the guide reception portions 102*a* and 102*b* of the receptacle docking connector 73 before the plug connectors 76*a* and 76*b* engage with the receptacle connectors 113*a* and 113*b*. Accordingly, the plug connectors 76*a* and 76*b* can be securely engaged with the receptacle connectors 113*a* and 113*b* without damages.

Additionally, with the plug docking connector 75 according to the second embodiment provided with the control portions 89*a* and 89*b*, the plug connectors 76*a* and 76*b* are connected with the cables 83*a*, 83*b*, 84*a*, and 84*b* (flexible portions) via the circuit boards 82*a* and 82*b*, and the flexible portion is held by the first holding portion and the second holding portion. Accordingly, the positions and the postures of the plug connectors 76*a* and 76*b* can be controlled. Specifically, since the plug connectors 76*a* and 76*b* are configured to be movable within a predetermined space, a tolerance can be minimized and the plug connectors 76*a* and 76*b* can be securely engaged with the receptacle connectors 113*a* and 113*b* without damages. Additionally, when not engaged with the receptacle connectors 113*a* and 113*b*, the plug connectors 76*a* and 76*b* can be maintained at a predetermined position and in a predetermined posture by position control and posture control by the control portions 89*a* and 89*b*. Specifically, deviation in a position and a posture of the plug connectors 76*a* and 76*b* at the time of mounting can be securely absorbed.

Additionally, with the receptacle docking connector 73 according to the second embodiment provided with the guide reception portions 102*a* and 102*b*, the guide portions 78*a* and 78*b* are inserted into the guide reception portions 102*a* and 102*b* before the plug connectors 76*a* and 76*b* engage with the receptacle connectors 113*a* and 113*b*. Accordingly, the plug connectors 76*a* and 76*b* can be securely engaged with the receptacle connectors 113*a* and 113*b* without damages.

Additionally, with the receptacle docking connector 73 according to the second embodiment, the receptacle connectors 113*a* and 113*b* are individually mounted on the board 106 and thereafter, at the time of attaching the board 106 to the casing of the portable terminal device, the guide shell 104 is attached together with the board 106. Accordingly, flatness (coplanarity) of the receptacle docking connector 73 with respect to the mounting surface of the board 106 can be excellently maintained to prevent a soldering failure due to poor flatness.

Additionally, with the receptacle docking connector 73 according to the second embodiment, the guide shell 104 covers the receptacle connectors 113*a* and 113*b*, and the guide shell 104 and the receptacle shells 105*a* and 105*b* electrically conduct with each other. Accordingly, while the receptacle shells 105*a* and 105*b* function as inner shells of the receptacle connectors 113*a* and 113*b*, the guide shell 104 is allowed to function as an outer shell of the receptacle connectors 113*a* and 113*b*. Additionally, since the guide shell 104 covers the receptacle connectors 113*a* and 113*b*, and is fixed to the board 106, coming-off of the receptacle connectors 113*a* and 113*b* from the board 106 must be prevented.

Additionally, although when a connector is further added to a docking connector having predetermined standard connectors such as a plurality of connectors conforming to the standard specification, there occurs a problem of increasing the docking connector in size, the plug docking connector 75 according to the second embodiment enables down-sizing thereof because the additional plug connectors 77*a* and 77*b* are arranged in the guide portions 78*a* and 78*b*. Similarly, the receptacle docking connector 73 according to the second embodiment enables down-sizing thereof because the additional receptacle connectors 103*a* and 103*b* are arranged in the guide reception portions 102*a* and 102*b*.

Figure 23:
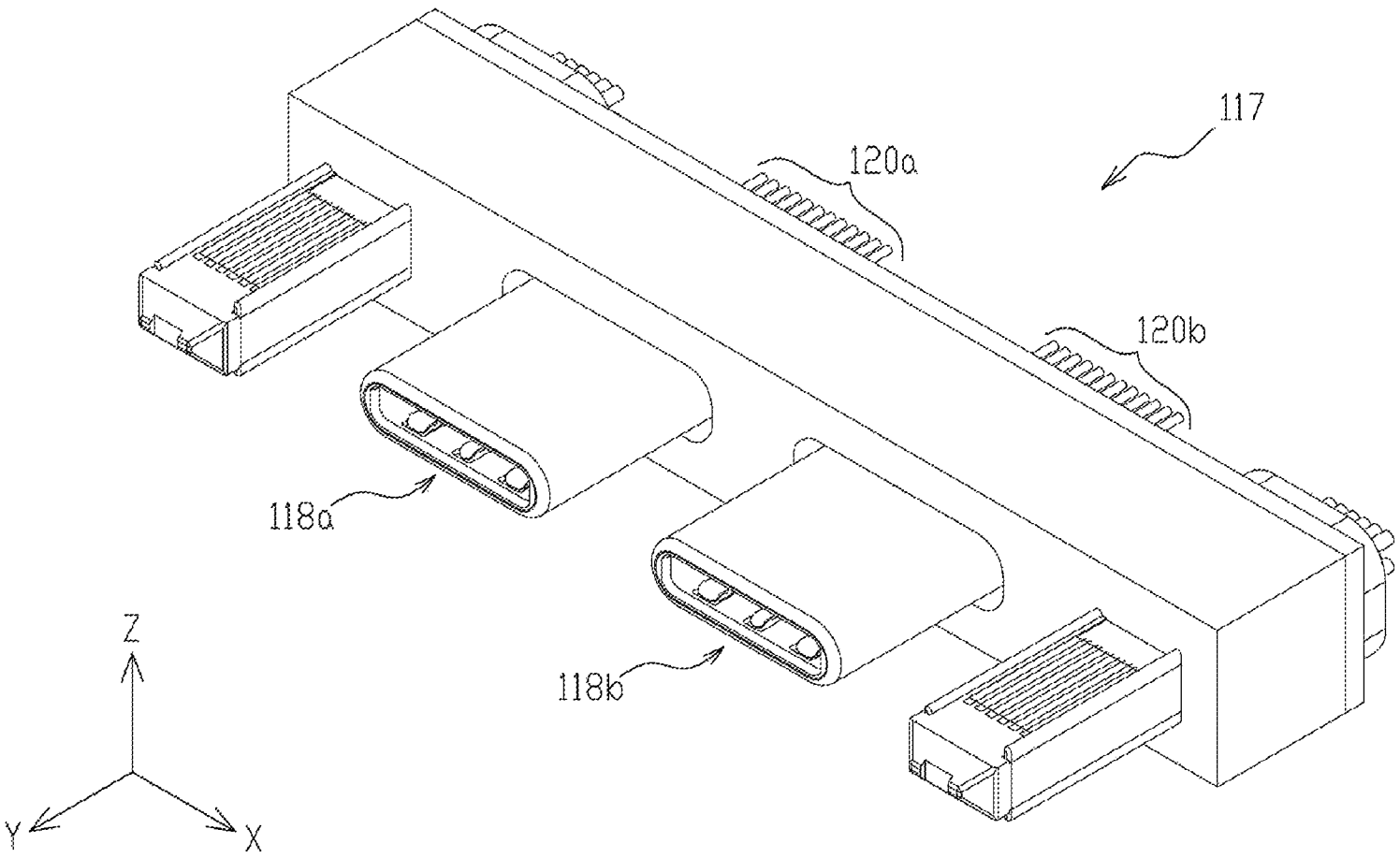
FIG. 23 is a perspective view showing an appearance of other plug docking connector.
Figure 24:
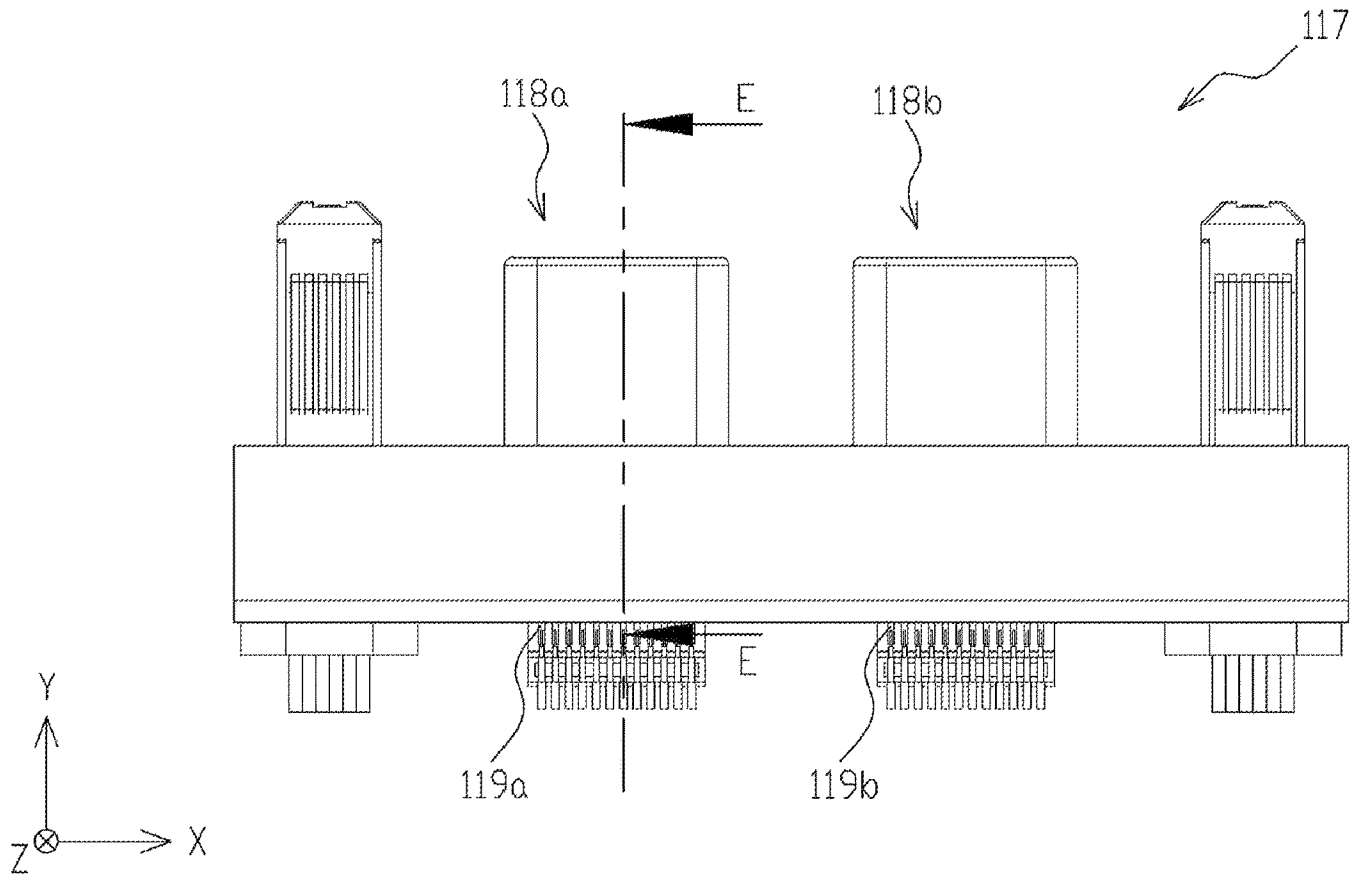
FIG. 24 is a bottom plan view showing the appearance of other plug docking connector.

In the above plug docking connector 75 according to the second embodiment, the plug connectors 76*a* and 76*b* are mounted on the circuit boards 82*a* and 82*b*, and the contacts 85*a*, 59*a*, and 85*b* of the plug connectors 76*a* and 76*b*, and the cables 83*a*, 83*b*, 84*a*, and 84*b* are electrically connected with each other via the circuit boards 82*a* and 82*b*. However, in place of such a configuration, for example, a plug docking connector 117 as shown in FIG. 23 can be used. FIG. 23 is a perspective view showing an appearance of the plug docking connector 117, FIG. 24 is a bottom plan view showing the appearance of the plug docking connector 117, FIG. 25 is an exploded view showing a configuration of the plug docking connector 117, and FIG. 26 is a sectional view taken along E-E in FIG. 24.

Figure 25:
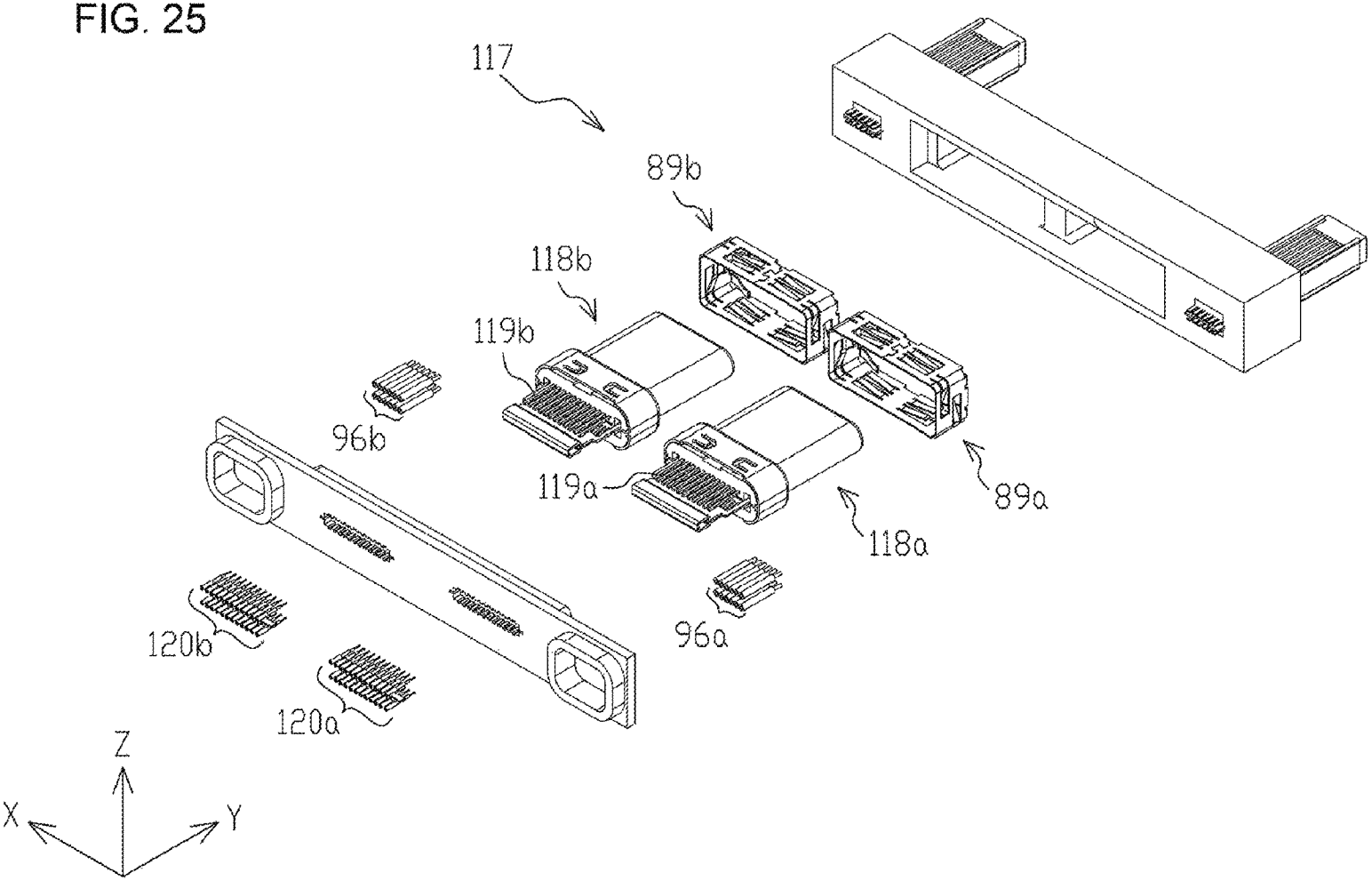
FIG. 25 is an exploded view showing a configuration of other plug docking connector.
Figure 26:
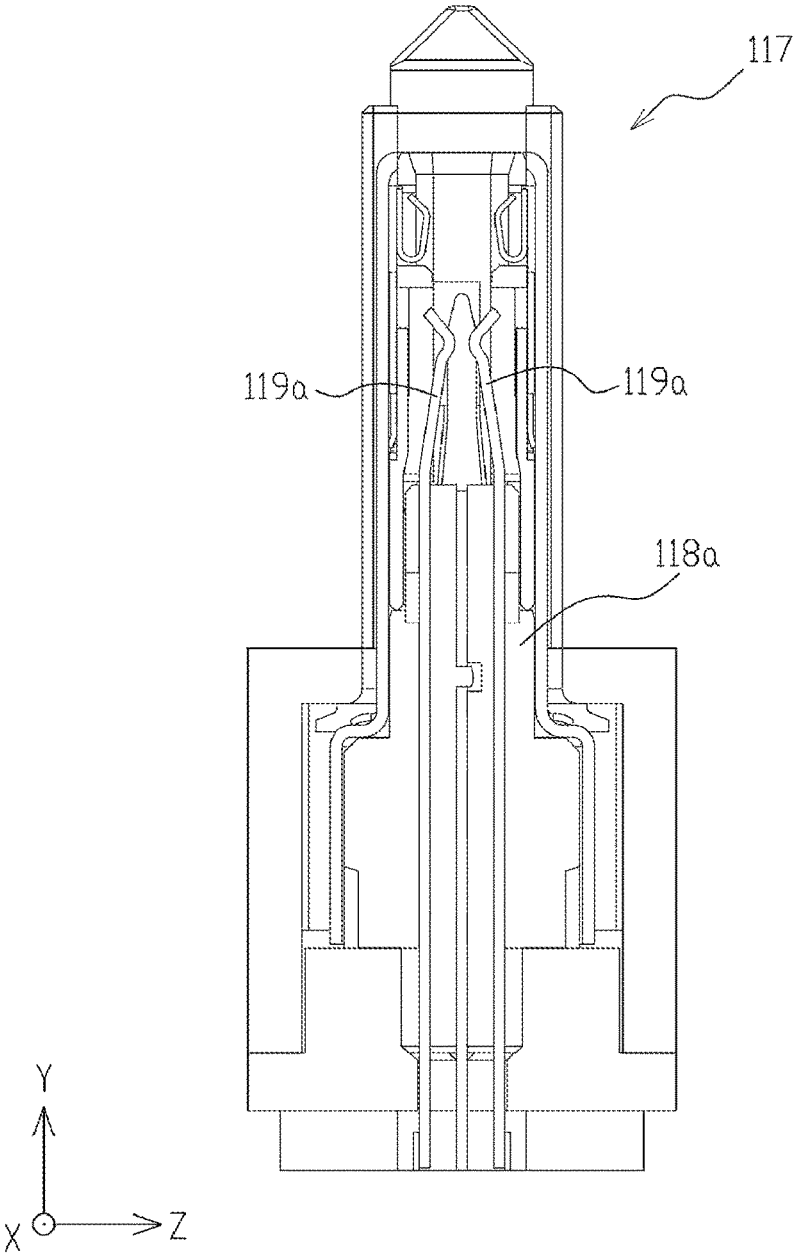
FIG. 26 is a sectional view showing the configuration of other plug docking connector.

As shown in FIG. 25 and FIG. 26, plug connectors 118*a* and 118*b* configuring the plug docking connector 117 are not mounted on the circuit board, and a plurality of contacts 119*a* and 119*b* of the plug connectors 118*a* and 118*b* and the cables 120*a* and 120*b* are directly connected by soldering or the like. Even when the plug docking connector 117 is mounted on an electronic apparatus or the like and a position relative to a printed board mounted on the electronic apparatus differs, connection with the printed board can be realized with ease without changing a shape or a length of the plurality of contacts 119*a* and 119*b* of the plug connectors 118*a* and 118*b*. Specifically, since the contacts 119*a* and 119*b* are connected with the cables 120*a* and 120*b*, connection of the cables 120*a* and 120*b* with the printed board of the electronic apparatus enables electrical connection of the plug connectors 118*a* and 118*b* with the printed board via the cables 120*a* and 120*b*.

Additionally, although in the above plug docking connector 75 according to the second embodiment, the control portion 89*a* controls a position and a posture of the plug connector 76*a*, and the control portion 89*b* controls a position and a posture of the plug connector 76*b*, the plug docking connector can be configured to include only the control portion 89*a*, or only the control portion 89*b*. When only the control portion 89*a* (or 89*b*) is provided, a position and a posture of the plug connector 76*b* (or 76*a*) are defined in advance, and only a position and a posture of the plug connector 76*a* (or 76*b*) are controlled.

Additionally, although in the above plug docking connector 75 according to the second embodiment, the control portions 89*a* and 89*b* control the postures of the plug connectors 76*a* and 76*b* by using the Y side elastic portion 94*a* and the convex portions 67*a* and 67*b* of the rear cover 81, a posture control portion having an elastic portion and a convex portion can be provided between the circuit boards 82*a* and 82*b* and the rear cover 81, so that the posture control portion controls the postures of the plug connectors 76*a* and 76*b*.

Additionally, although in the above receptacle docking connector 73 according to the second embodiment, as shown in FIG. 21, the other end portions of the contacts 107*a* and 107*b* are electrically connected with the wires 109*a* and 109*b*, in place of such a configuration, a second engagement portion can be provided which engages with a connector mounted on the board 106 in advance other than a first engagement portion in which the additional receptacle connectors 103*a* and 103*b* engage with the additional plug connectors 77*a* and 77*b*. In this case, one end portions of the contacts 107*a* and 107*b* electrically connect with the contacts 116*a* and 116*b* and contacts not shown of the additional plug connectors 77*a* and 77*b*, and the other end portions of the contacts 107*a* and 107*b* electrically connect with contacts of the connector mounted on the board 106 in advance.

Figure 27:
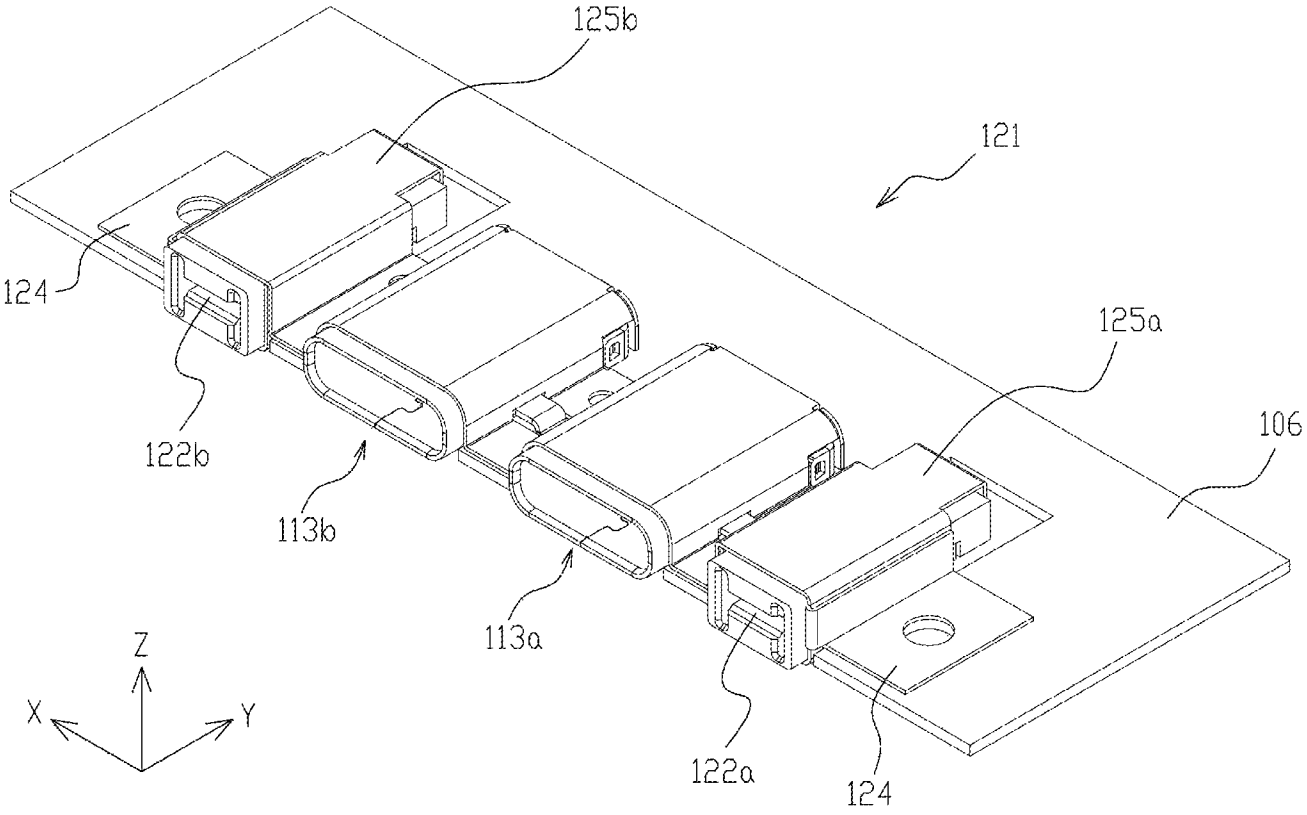
FIG. 27 is a perspective view showing an appearance of other receptacle docking connector.
Figure 28:
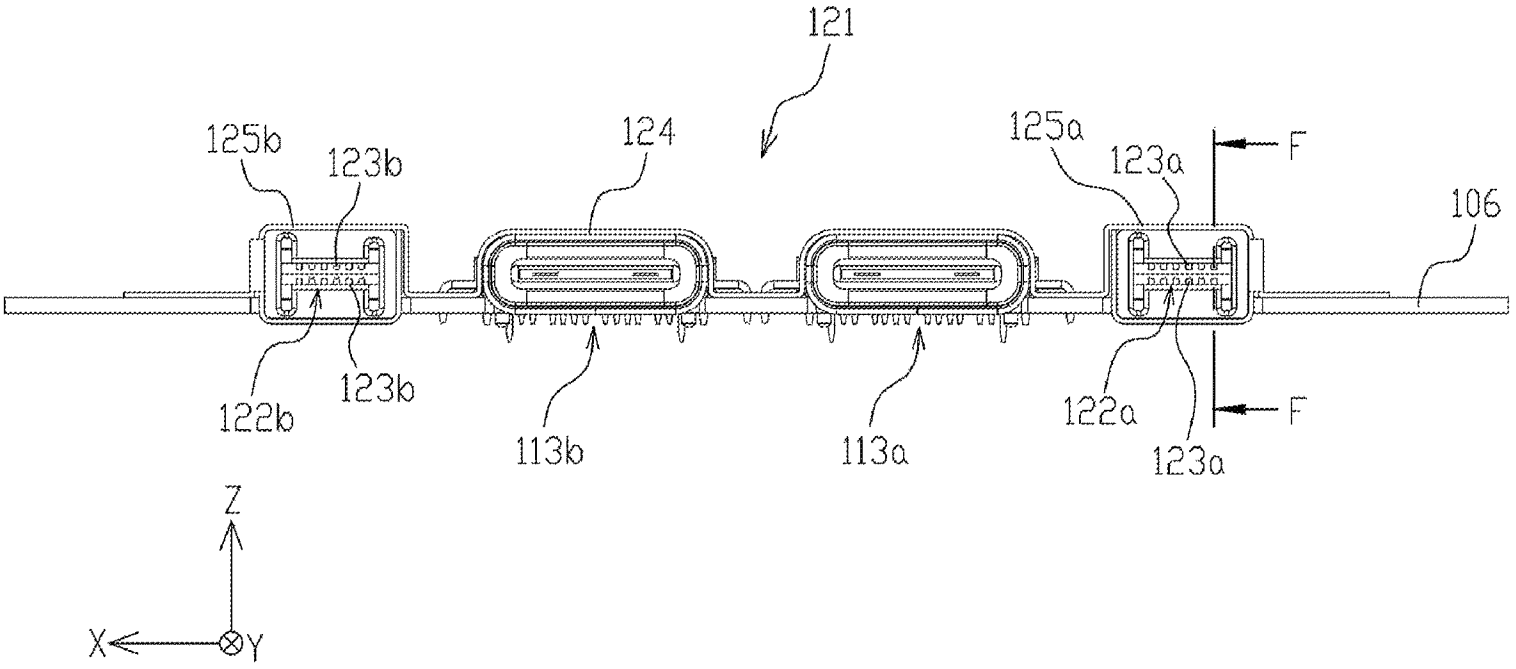
FIG. 28 is a front view showing the appearance of other receptacle docking connector.
Figure 29:
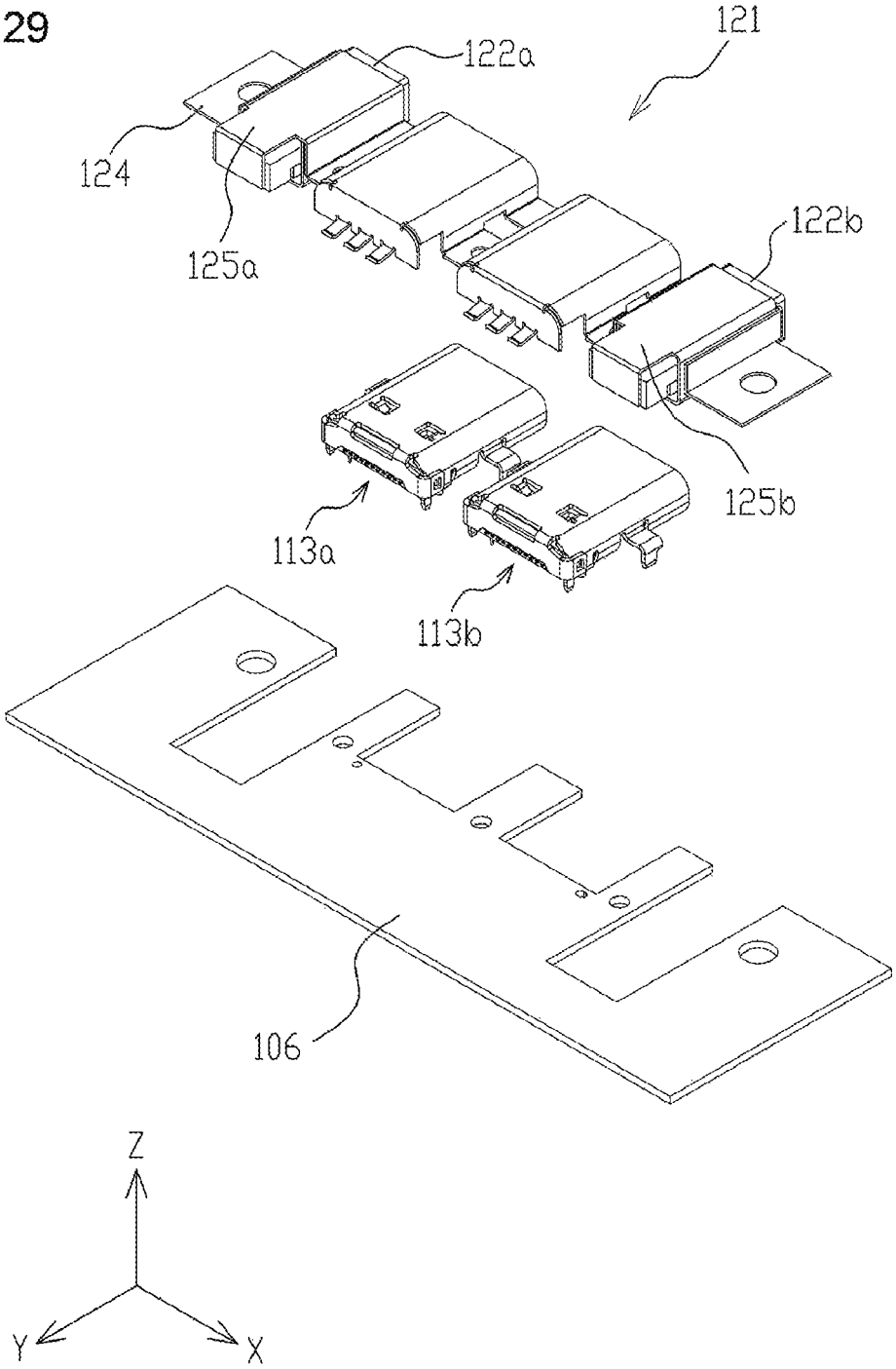
FIG. 29 is an exploded view showing a configuration of other receptacle docking connector.
Figure 30:
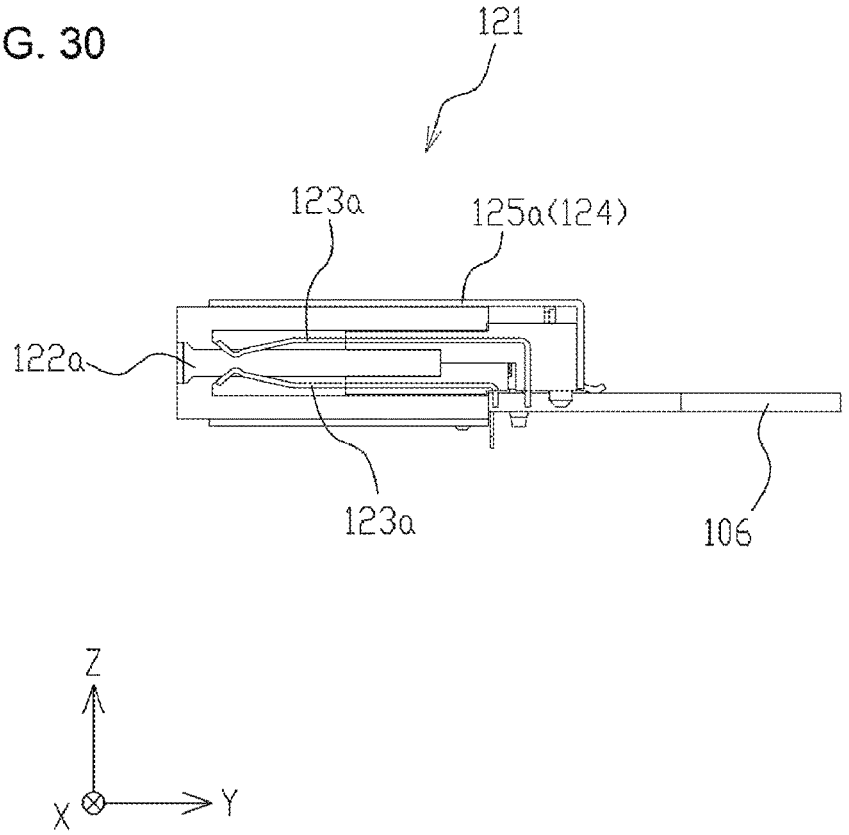
FIG. 30 is a sectional view showing the configuration of other receptacle docking connector.

Additionally, although in the above receptacle docking connector 73 according to the second embodiment, as shown in FIG. 21, the other end portions of the contacts 107*a* and 107*b* are electrically connected with the wires 109*a* and 109*b*, in place of such a configuration, for example, a receptacle docking connector 121 can be used as shown in FIG. 27. FIG. 27 is a perspective view showing an appearance of the receptacle docking connector 121, FIG. 28 is a front view showing the appearance of the receptacle docking connector 121, FIG. 29 is an exploded view showing a configuration of the receptacle docking connector 121, and FIG. 30 is a sectional view taken along F-F in FIG. 28. As shown in FIG. 27 to FIG. 30, to contacts 123*a* and 123*b* of additional receptacle connectors 122*a* and 122*b* configuring the receptacle docking connector 121, no wire is connected. Additionally, a guide shell 124 configuring the receptacle docking connector 121 supports the additional receptacle connectors 122*a* and 122*b* in the insertion direction (the +Y direction) in which the guide portions of the plug docking connector are inserted into guide reception portions 125*a* and 125*b*.

Additionally, although the above receptacle docking connector 73 according to the second embodiment includes the two guide reception portions 102*a* and 102*b*, one guide reception portion, or three or more guide reception portions may be provided. Even when three or more guide reception portions are provided, the guide reception portions are formed integrally.

Additionally, although the receptacle docking connector 73 according to the second embodiment, which is a reversible connector, includes the two additional receptacle connectors 103*a* and 103*b*, one additional receptacle connector may be provided. In this case, when the plug connector 76*a* engages with the receptacle connector 113*a*, the additional plug connector 77*a* engages with the additional receptacle connector, and when the plug connector 76*b* engages with the receptacle connector 113*b*, the additional plug connector 77*b* engages with the additional receptacle connector.

Additionally, although in the above second embodiment, only the front end portions of the guide portions 78*a* and 78*b* protrude more than the front end portions of the plug connectors 76*a* and 76*b*, only front end portions of the guide reception portions 102*a* and 102*b* may protrude more than front end portions of the receptacle connectors 113*a* and 113*b*. Additionally, the front end portions of the guide portions 78*a* and 78*b* may protrude more than the front end portions of the plug connectors 76*a* and 76*b*, and the front end portions of the guide reception portions 102*a* and 102*b* may protrude more than the front end portions of the receptacle connectors 113*a* and 113*b*.

Although the above plug docking connectors according to the respective embodiments are each provided with two USB Type-C plug connectors, the plug docking connector may be provided with three or more USB Type-C plug connectors. Additionally, a USB Type-C plug connector may be replaced by other plurality of plug connectors conforming to the standard specification than a USB Type-C plug connector. Additionally, a plurality of predetermined standard plug connectors having a predetermined standard may be provided other than the plug connectors conforming to the standard specification.

Similarly, although the above receptacle docking connectors according to the respective embodiments are each provided with two USB Type-C receptacle connectors, the receptacle docking connector may be provided with three or more USB Type-C receptacle connectors. Additionally, a USB Type-C receptacle connector may be replaced by other plurality of receptacle connectors conforming to the standard specification than a USB Type-C receptacle connector. Additionally, a plurality of predetermined standard receptacle connectors having a predetermined standard may be provided other than the receptacle connectors conforming to the standard specification.

Additionally, although the above respective embodiments are configured such that a position and a posture of the plug connector are controlled, the embodiments may be configured such that only a position of the plug connector is controlled, or such that only a posture of the plug connector is controlled.

Additionally, although the above plug docking connectors according to the respective embodiments are each provided with two or four additional plug connectors, the plug docking connector may be provided with one, or three, or five or more additional plug connectors. Similarly, although the above receptacle docking connectors according to the respective embodiments are each provided with two or four additional receptacle connectors, the receptacle docking connector may be provided with one, or three, or five or more additional receptacle connectors.

The foregoing described embodiments are recited for facilitating understanding of the present invention and not to be construed as limiting the present invention. Accordingly, each element disclosed in the above embodiments intends to include all design changes and equivalents within a technical range of the present invention.

The invention claimed is:

1. A plug unit including at least two predetermined standard plug connectors, the predetermined standard plug connectors each including a first plug contact that connects with a first connection terminal of a predetermined standard receptacle connector and a second plug contact that connects with a second connection terminal of the predetermined standard receptacle connector, the plug unit comprising:

a single first insulator that holds the first plug contact which one of the at least two predetermined standard plug connectors has and the first plug contact which the other of the at least two predetermined standard plug connectors has, a single second insulator that holds the second plug contact which the one of the at least two predetermined standard plug connectors has and the second plug contact which the other of the at least two predetermined standard plug connectors has, a first ground plate arranged between the first and second plug contacts which the one of the at least two predetermined standard plug connectors has, and a second ground plate arranged between the first and second plug contacts which the other of the at least two predetermined standard plug connectors has.

2. The plug unit according to claim 1, comprising a guide portion to be inserted, when docking with a receptacle unit including the predetermined standard receptacle connector, before the at least two predetermined standard plug connectors engage with the predetermined standard receptacle connector, into a guide insertion portion of the receptacle unit.

3. The plug unit according to claim 2, wherein the guide portion includes a first additional connector.

4. A plug unit including a plug connector, the plug unit comprising:

a guide portion to be inserted, when docking with a receptacle unit including a receptacle connector, before the plug connector engages with the receptacle connector, into a guide insertion portion of the receptacle unit, and a first additional connector that connects with a second additional connector provided with the receptacle unit and that is arranged in the guide portion, wherein the first additional connector includes a plurality of first contacts which connect with second contacts of the second additional connector, at least two of the plurality of first contacts are arranged in such a state that the connection portions of the at least two of the plurality of first contacts which connect with the second contacts expose to one direction.

5. The plug unit according to claim 4, wherein:

a cover which covers the plug connector has an opening portion for exposing an engagement portion in which the plug connector engages with the receptacle connector, and between an outer wall portion of the plug connector and a wall portion forming the opening portion, a predetermined space is formed such that the plug connector can move on a cross plane crossing an engagement direction of engagement with the receptacle connector, the plug unit comprising a control portion which controls, relative to the opening portion, at least either one of a position and a posture of the plug connector.

6. The plug unit according to claim 4, wherein:

the guide portion and a cover which covers the plug connector are formed of resin, and the guide portion has metal incorporated therein.

7. The plug unit according to claim 4, wherein the guide portion is formed in a periphery of the plug connector.

8. The plug unit according to claim 4, wherein a width of the guide portion in a direction orthogonal to an alignment direction in which the plug connector and the guide portion is aligned is not less than an internal diameter width of an internal diameter of the receptacle connector in the direction orthogonal to the alignment direction.

9. The plug unit according to claim 4, wherein:

the connection portions of the at least two of the plurality of first contacts are arranged on a top surface of the guide portion.

10. The plug unit according to claim 4, wherein the plug connector is a reversible connector.

11. The plug unit according to claim 1, comprising:

a coupling portion coupling the first ground plate and the second ground plate.

12. The plug unit according to claim 4, wherein the first additional connector is connected with a wire when the plug connector is mounted to a board, or the first additional connector is mounted to a board when the plug connector is connected with a wire.

13. A plug unit including a plug connector, the plug unit comprising:

a guide portion to be inserted, when docking with a receptacle unit including a receptacle connector, before the plug connector engages with the receptacle connector, into a guide insertion portion of the receptacle unit, and a first additional connector that connects with a second additional connector provided with the receptacle unit and that is arranged in the guide portion, wherein the first additional connector includes a first contact which connects with a second contact of the second additional connector and an insulator which is formed by a separate member from the guide portion and which holds the first contact.

14. The plug unit according to claim 13, wherein:

a connection portion of the first contact is arranged on a top surface of the guide portion.

15. The plug unit according to claim 13, wherein the first additional connector is connected with a wire when the plug connector is mounted to a board, or the first additional connector is mounted to a board when the plug connector is connected with a wire.

* * * * *